US010501937B2

(12) United States Patent
Karstens

(10) Patent No.: US 10,501,937 B2
(45) Date of Patent: Dec. 10, 2019

(54) EXPANDABLE SUSTAINABLE MEMBER BEAM AND PATTERN

(71) Applicant: Christine Inez Karstens, Sacramento, CA (US)

(72) Inventor: Christine Inez Karstens, Sacramento, CA (US)

( * ) Notice: Subject to any disclaimer, the term of this patent is extended or adjusted under 35 U.S.C. 154(b) by 0 days.

(21) Appl. No.: 15/703,993

(22) Filed: Sep. 14, 2017

(65) Prior Publication Data

US 2019/0078331 A1 Mar. 14, 2019

(51) Int. Cl.
*E04C 3/00* (2006.01)
*E04C 3/32* (2006.01)

(52) U.S. Cl.
CPC ..... *E04C 3/32* (2013.01); *E04C 3/005* (2013.01)

(58) Field of Classification Search
CPC ..... E04C 3/32; E04C 3/005; E04H 12/185; E04H 12/182; E04H 12/187
USPC ..... 52/67, 118
See application file for complete search history.

(56) References Cited

U.S. PATENT DOCUMENTS 1,150,232 A * 8/1915 Starr ..... F16L 19/04 254/400
2,675,211 A * 4/1954 Regoord ..... E04H 12/182 182/141
2,739,833 A * 3/1956 Schenkel ..... B60P 3/34 254/92
2,846,731 A * 8/1958 Abler ..... E04B 1/3404 52/169.9
2,862,253 A * 12/1958 Place ..... B60P 3/34 296/171
3,367,632 A * 2/1968 Vail ..... A01K 31/14 119/428
3,382,626 A * 5/1968 Bohr ..... B66C 23/64 52/108
3,474,579 A * 10/1969 Kieser ..... E04H 12/18 52/108
3,503,164 A * 3/1970 Medal ..... E04C 3/005 52/108
3,751,863 A * 8/1973 Lyons ..... E04H 12/185 52/111
3,832,810 A * 9/1974 Johnston ..... E04B 2/74 52/67

(Continued)

*Primary Examiner* — Brent W Herring

(57) ABSTRACT

A process, mechanical method, and mechanical utility invention that creates an expandable sustainable member beam with utility in its' substantially different shape, mobility, multi-functional capabilities, and sustainability from its' conventional counter part. It can be utilized independently, as a utility stand, in plurality, sharing a base(s) and platform(s), as a step, or in conjunction with other expandable sustainable member beams from which to build. Some embodiments may replace a conventional wood or metal 2"×4"×8' stud in many applications. Additional utilities include, but not limited to: a post, concrete form, assistive device for mobility challenged individuals, independent balance, self-leveling, varying angular degree manipulation, elevational deployment and retraction capabilities. It can be substantially shortened for transport and deploy to varying longitudinal values to regain its utility upon user demand. Thereafter, it can be uninstalled and used again for like or different utilities, making it largely sustainable.

2 Claims, 18 Drawing Sheets

(56) References Cited

U.S. PATENT DOCUMENTS 4,231,200 A * 11/1980 Henderson ..... E04H 12/182 182/19
4,258,825 A * 3/1981 Collins ..... B66F 11/04 180/321
4,259,825 A * 4/1981 Frosch ..... E04H 12/18 52/645
4,309,854 A * 1/1982 Vendramini ..... E04H 12/20 212/264
4,580,377 A * 4/1986 Sundin ..... E04H 12/182 254/400
4,637,192 A * 1/1987 Brown ..... E04H 12/18 428/12
4,662,130 A * 5/1987 Miura ..... E04H 12/185 52/108
4,785,309 A * 11/1988 Gremillion ..... H01Q 1/1235 343/883
4,785,590 A * 11/1988 Jones ..... E04B 1/34305 160/222
4,974,265 A * 12/1990 Maggio ..... A47K 3/325 135/901
5,014,484 A * 5/1991 Tanizawa ..... E04B 1/19 52/645
5,101,215 A * 3/1992 Creaser, Jr. ..... E04H 12/182 343/883
5,319,895 A * 6/1994 Ray ..... E04H 3/26 472/92
6,046,706 A * 4/2000 Vargas ..... H01Q 1/1235 343/880
6,119,409 A * 9/2000 Makar ..... A01K 1/00 441/129
RE37,559 E * 2/2002 Marue ..... B60P 3/18 248/188.5
6,430,879 B1 * 8/2002 Nuiry ..... E04B 1/34305 4/498
7,195,216 B2 * 3/2007 Wang ..... A47G 33/06 248/157
8,381,460 B1 * 2/2013 McDermott ..... E01D 21/00 52/117
2006/0201076 A1 * 9/2006 Blackwelder ..... E04H 12/182 52/118
2014/0318040 A1 * 10/2014 Edwards ..... E04H 12/182 52/118
2016/0281362 A1 * 9/2016 Urheim ..... E04H 3/28

* cited by examiner

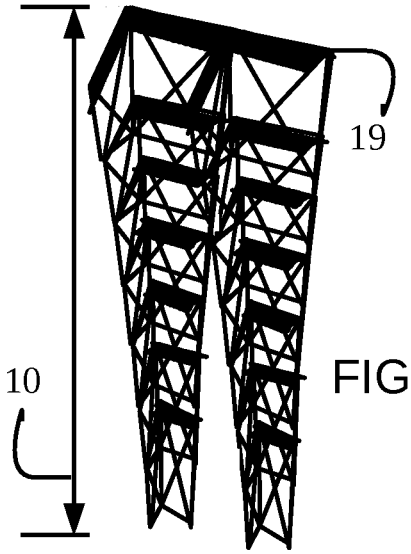
FIG. 4A
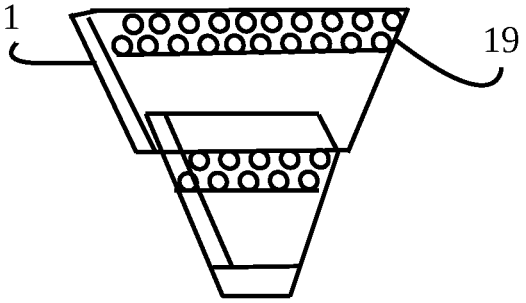
FIG. 4B
FIG. 4C
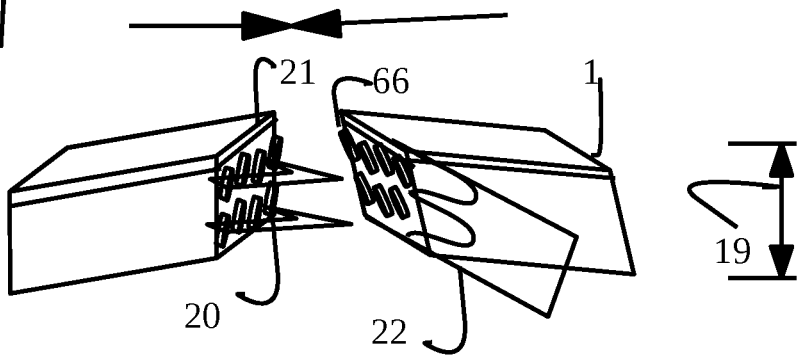
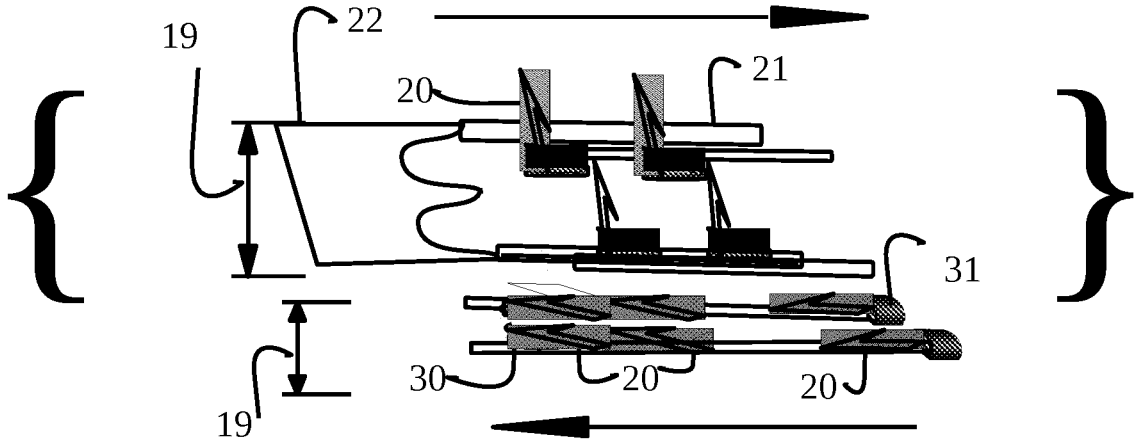

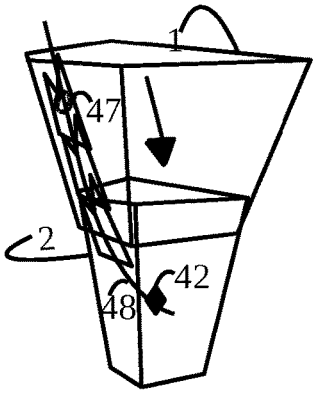
FIG.16
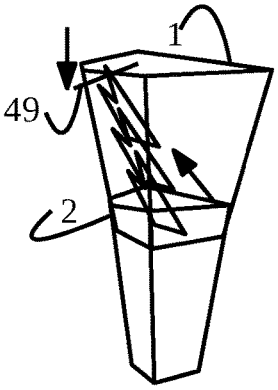
FIG.16A
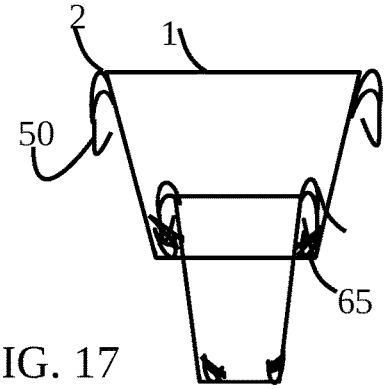
FIG. 17
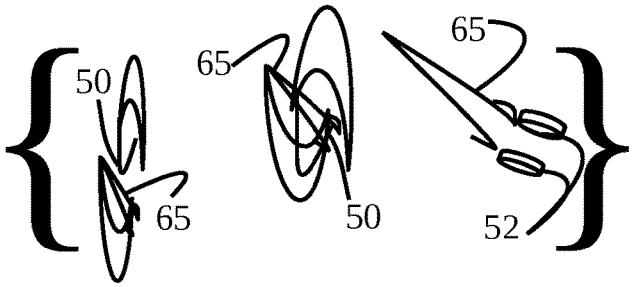
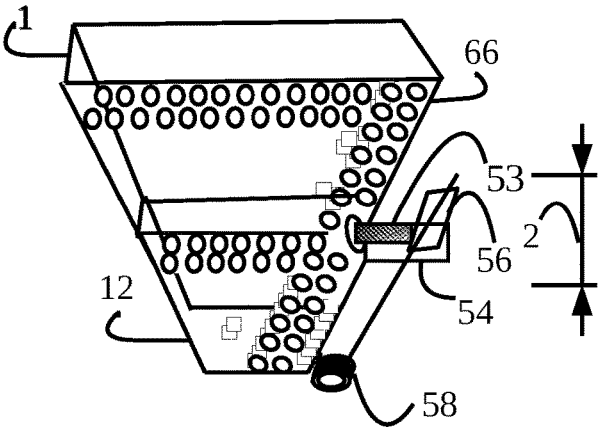
FIG.18
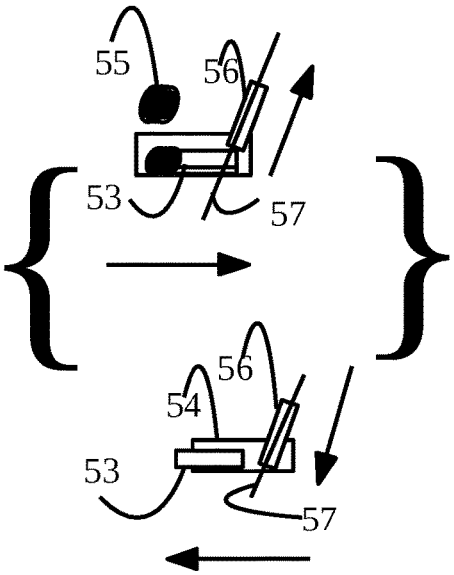

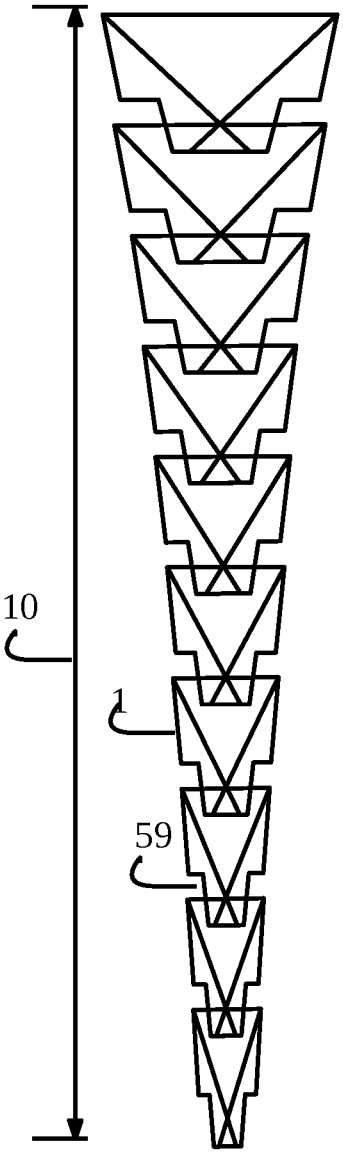
FIG. 19
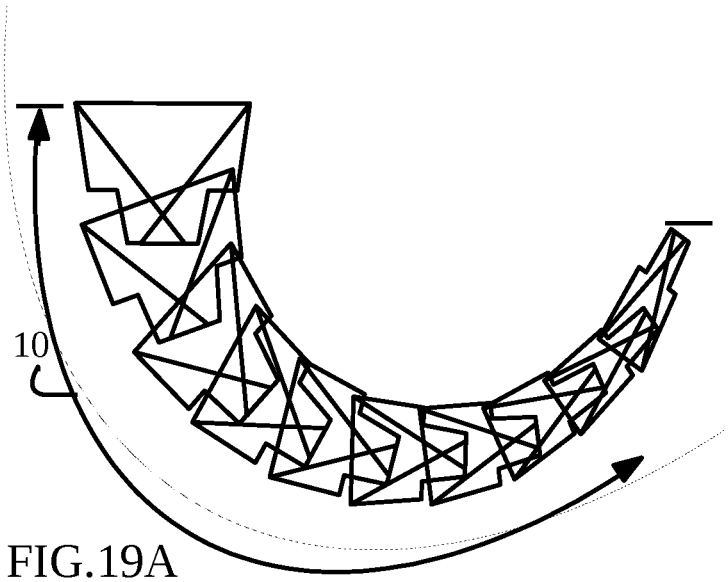
FIG.19A
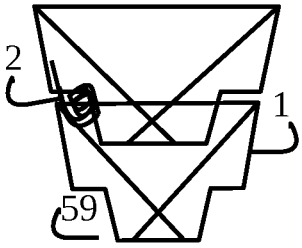
FIG. 19B
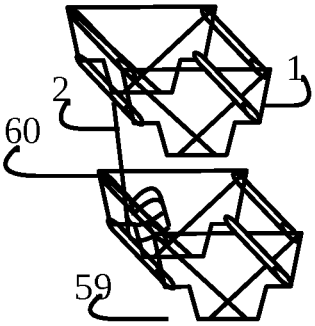
FIG. 19C
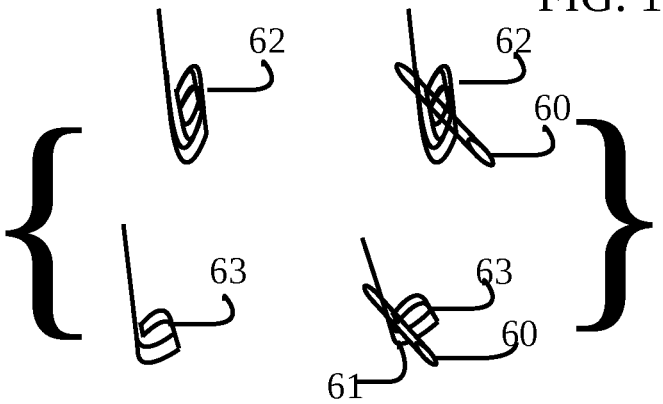

EXPANDABLE SUSTAINABLE MEMBER BEAM AND PATTERN

BACKGROUND OF INVENTION

This invention was created in the interest of the construction industry and mobility assistive devices for mobility challenged individuals and situations. In construction there are many instances where beams are used that the bulkiness of a conventional wood or metal beam hinders the transport of the beam and utility of the beam. In many cases the transport mechanism is a human being or a cargo space that is more compact than the longitudinal value of one or more conventional beam(s). Thus, the need arises for a more compact version of the conventional beam with more mechanical utility. Additionally, many mobility and self care devices are bulky, thus inhibiting their mobility and use outside the home. Applying the created pattern, process, and method for mechanical utility, the invented expandable sustainable member beam re-defines a conventional self care device. By changing its' shape and form, according to the processes and patterns set forth in this document; it gains the invented mechanical attributes, such as, but not limited to: segmenting, expandable and retractable capabilities, rigidity, independent balance, elevational deployment, angular and dimensional manipulation. Additionally, the mechanical attributes invented create gains in utilities in the following ways, but not limited to: economy in mobility, economy in accessibility, economy in size, economy in knowledge of the art and science of the construction industry required to create usefulness, economy in force, and or, user effort, economy in tools required to utilize fully, and most importantly, economy in waste; thereby, creating a member beam with sustainability.

A prior art approach is referenced in U.S. Pat. No. 4,259,825, which depicts a series of rods rapped around a helix shape. Although, extremely different in form and shape, its' basic functionality is similar, insofar as, it is a member beam with mobility capabilities. However, it does not have many of the created utilities set forth in this document and the uses are nearly singular in value. Further more, based on it's complexity, the invention might require a person of similar skill as the person(s) in the publication in order to utilize it fully. Yet, another prior art exists in U.S. Pat. No. 4,637,192. In this depiction the art is similar at first glance. However, upon further review, the utility is intended for mostly large industrial applications and requires skilled assemblage at the job site. It is mostly unsustainable and has significantly large mobility requirements. Additionally, it also does not contain many of the created utilities set forth in this document. As referenced in U.S. Pat. No. 4,259,825, another similar in utility item is referenced in U.S. Pat. No. 3,503,164, this prior art has its' limitations, in that, when one side is heated by the sun it causes it to bend. Another prior art approach referenced in U.S. Pat. No. 4,258,825 is U.S. Pat. No. 3,474,579; where as, the drawback of the prior art is that considerable force is necessary to roll up the structure. Similarly, there is much prior art involving segmenting and telescopic in nature. However, much of it is for production of singular use items, such as an umbrella or telescope. Many of them have limited capabilities and are not designed for the construction industry or assistive device community. Additionally, of the similar search results found, none possessed the multi-functional utilities as the ones set forth in this document. Also, of the similar search results found, none created a pattern and process to render the utilities created in other assistive devices and mechanisms. Furthermore, of the similar search results found, none provided a readily available means for expandable and retractable capabilities, reuse without loss in volumic value, loss in utility, or loss in materials when the use seizes. Thus, exists a great need for an expandable sustainable member beam, such as the one invented and set forth in this document; an expandable sustainable member beam with readily available multi-functional capacities that may be used with ease; such as: an invented means of independent balance, expandable and retractable capabilities, self-leveling capabilities, elevational deployment capabilities, and reuse capabilities, rendering it sustainable. Thereby, allowing for the material apparatus to be used again for the same, or different functions, vs the current conventional model of disposing of member beams and construction materials into landfills when a use seizes. Thus, none of the similar searches found art that offered, nor specifically identified, a multi-functional device with a sustainability factor.

Therefore, it is thus promoted in this document that a great need still exists for a process, pattern, and mechanical method for manufacture that solves the problem of sustainability, economy in mobility, economy in the use of tools needed to adapt a member beam for usefulness, the economy of skilled labor that might be required in order to use or assemble a member beam(s), the economy of blunt force, the economy of connectivity with other like member beams or with other building materials. Furthermore, there is a crucial need for a process, pattern, and mechanical method that creates a mechanical assistive apparatus from a similar existing type apparatus that is deployable from varying elevations for workers, everyday citizens, and especially citizens in need of assistive devices.

Furthermore, there are instances in the construction industry when the building of structures, shelters, signs, etc., where by there is limited availability of items necessary to build with a conventional member beam. Such as, limited access to tools, either by location or environment, and or limited number of persons available for labor in erecting a structure. Thus, the need arises for a reusable expandable sustainable member beam that is capable of connectivity by which to attach to other member beams and other construction materials without the need for a significant number of workers or tools. Additionally, the need arises for a means of achieving independent balance, varying dimensional values, and varying angular values, required in building a structure without the need for cutting, tools, or skilled labor.

Furthermore, there are instances where human beings need to erect a structure that is temporary, and is capable of being built by a single individual with limited skill in the art and science of construction. Therefore, a need arises for a beam that can be easily utilized with self contained building attributes. Such as, pre-assembled, independent balance, self contained stability capabilities, self contained framing capabilities, without the need for tools or blunt force, self-leveling capabilities, and ease in connectivity. Also, in erecting temporary structures, the need arises for beam(s) that may be shortened for transport, than expanded for use, and thereafter, are readily available to be retracted and relocated upon user demand.

Additionally, in construction, there arises a need for mechanical assistance that enhances safety and decreases risky cumbersome labor. Such as, when a worker is on a ladder or roof; often times the worker needs to travel to and fro from the work elevation to the ground floor elevation in order to retrieve tools or supplies. The created expandable sustainable member beam can be deployable from varying work elevations and has mechanical means readily available to manipulate the dimensional values and angular degrees to meet the workers' needs. Thus, reducing the need for a worker to travel to and fro to the ground floor elevation. Therefore, eliminating the risks of injury during travel. The expandable sustainable member beam, when manufactured as a work stand, can go with the worker to an elevated work level and can than be deployed from that elevation to hold a tool, such as a drill, that might need to be set down momentarily. When the worker moves location at the elevation, the expandable sustainable member beam can be retracted and ascends to the existing elevation, and thereafter can be moved without the worker having to descend to the floor level.

Similarly, in daily life, and particularly in the daily life of a person in need of mobility assistive devices, there are many instances where bending over to acquire or utilize such things as a stepping stool can be difficult, painful or impossible. Therefore, such a need arises to create a self care device that eliminates the need to bend in order to use the device. By using the process, pattern and mechanical method for manufacture set forth in this document, a self care device such as a stepping stool can now be manufactured to have the same utility as its' conventional counter part while gaining the utility of eliminating bending to establish usefulness. Additionally, the rendition created from the pattern is now capable of decreasing its' dimensional values and retracting; thereby, gaining the utility of ease in mobility. Thus, an opportunity is gained for enabling a mobility challenged individual to utilize the device without the assistance of another individual. Additionally, many other assistive utilities are created by applying the process, pattern, and method for manufacture set for in this document, and recited forward as an embodiment with the following capabilities, such as, but not limited to, ease in transport, ease in connectivity, independent balance, self-leveling, elevational and angular manipulation.

It is the object of this invention to create an expandable sustainable member beam that is substantially more transportable through use of segmented sections than its' conventional non-expandable and non-sustainable counter part. Thus, solving the problem of economy in mobility and sustainability.

It is also the object of this invention to create a pre-assembled expandable sustainable member beam with interchangeable components that requires little to no tools in order to regain longitudinal value, rigidity, and utility. Thus, solving the problem of the economy of tools.

It is further the object of this invention to use the process, pattern, and mechanical method for manufacture set forth in this document, to create mechanical mobility assistive devices for many existing self care needs that reduce or eliminate the need for bending and reaching by mobility challenged individuals. Also, to create assistive devices that are substantially greater in utility in the following ways: independent balance, segmenting, self-leveling capabilities, rigidity, stability, elevational deployment, and expandable and retractable capabilities allowing for a means of greater mobility.

It is further the object of this invention to create an expandable sustainable member beam which is sustainable in value. By utilizing the expansion, retraction, and connectivity capabilities of the expandable sustainable member beam set forth in this document; the expandable sustainable member beam may be disconnected from other like member beams and building materials and retracted for transport to another location of need, without the loss of material support, volumic value, utility, connectivity or integrity in strength. Rendering the expandable sustainable member beam a device that regains its' full usefulness; thereby, sustainable in value.

BRIEF SUMMARY OF INVENTION

The process of creating a pattern with the created mechanisms set forth in this document that are a pattern, process, method, and mechanical utility for manufacture that when applied to a geometrical shape, or groupings of geometrical shapes, creates an expandable sustainable member beam that has substantially more utility than that of a conventional metal or wood 2"×4"×8' beam in one or more of the following attributes: sustainability, economy of mobility, economy in multi-functions, independent balance, self-leveling without the use of cutting or tools, expansion and retraction without the use of cutting or tools, sub-surface puncture capabilities, deployment from varying elevations capabilities, segment(s) with a mechanical means for restoring rigidity while allowing for expansion, capabilities of receiving a detachable inter-changeable base(s), and or, platform(s) without the use of tools, framing capabilities without the use of cutting or tools, temporary shelter capabilities without the use of cutting or tools, creating a work platform, creating a step or stool without the need to establish at floor elevation, creating assistive device(s) without the need to establish at floor elevation, creating assistive device(s) with economy in mobility. The pattern process includes: creating a pattern from an original conventional shape to one of having segment(s) and walls of diminishing or varying dimensional values, beginning from the widest dimensional value of the shape, so that the segment(s) with smaller dimensional values may be housed in segment(s) with larger dimensional values. Thereafter, manufacturing the patterned shape in the form of segment(s), thus causing it to lose its' original dimensional values and original rigid form, and thus becomes segment(s) with longitudinal or lateral values with one or more sides, such as, but not limited to; rectangle(s), cylinder(s), or column(s) or grouping there of. The new rendering is manufactured, and or, fitted with the invented mechanism, set forth in this document, to provide means of rigidity by either, compression and expansion, or movement of the rigidity mechanism, where as to allow segment(s) to pass the previous segment(s) uninhibited during deployment, while prohibiting reverse motion without user intervention, thus restoring rigidity among the segment(s). The rigidity mechanism may have several embodiments, such as, but not limited to the following: I. Segment wall(s) that are designed to compress during deployment, while thereafter expanding, and thus creating rigidity. II. Spike(s) that compress during deployment, while thereafter expanding to create rigidity. III. And or, key(s) that are fitted to the segment(s) walls and allow for forward movement of segment(s) from amongst the housing or previous segment(s), thus allowing segment(s) to pass uninhibited during deployment while prohibiting reverse motion without user intervention. The embodiments of rigidity mechanisms, set forth in this document are recited as, but not limited to, spike(s) or key(s). In one embodiment, the expandable sustainable member beam is fitted with a mechanical means to receive one or multiple base(s), and or, platform(s). Therefore, creating the utility of an expandable sustainable member beam with the utility of receiving a base for which to erect the beam without the need for other beams or materials required to establish independent balance. Additionally, several embodiments of the invented base are possible with added utilities set forth in this document, such as, but not limited to, a base with the capabilities of angular manipulation at varying degrees without the use of cutting or tools, built in sub-surface attachment capabilities, and a mechanical means of receiving other like member beams or materials independently, without the use of outside tools or materials.

An example of one embodiment that can be achieved using the invented pattern, process, and method for manufacture set forth in this document, as would be applied to an intended use of which would be of the same functions as a conventional 2"×4"×8' rigid metal beam. The beams' dimensional values would be re-patterned, where as an appropriate latitudinal value would be established for the widest segment; thereafter, the pattern would provide for the longitudinal values of the beams' dimensions to be decreased over the span of the beam. In this embodiment, the expandable sustainable member beams' walls might be derived from a solid sheet of material, such as metal, that is pressed into a three sided shape. The beam is manufactured as segments along predetermined lateral values, thus creating segment(s) that will be housed inside one another. Furthermore, the segments are manufactured with a rigidity mechanism, such as, spike(s), and or, key(s). As previously recited in this document, the rigidity mechanism possesses a mechanical means of allowing the inner segment(s) of smaller dimensional values to pass by the outer segment(s) uninhibited. Additionally, where as the spike(s), and or, key(s) are created to prohibit the segment(s) from reverse motion and retracting without user or mechanical intervention. Therefore, creating an additional utility of regained rigidity. Thus, creating an expandable sustainable member with substantially more economy of mobility than its' conventional singular shaped, metal counter part. Furthermore, one embodiment of the created pattern, process, and method for manufacture, set forth in this document, includes an expandable sustainable member beam(s) with a mechanical receiver(s) with means of receiving one or multiple base(s), and or, self-leveling detachable base(s), and or, platform(s). In this embodiment, the receiver is manufactured in the smallest or inner most segment of the expandable sustainable member beam. Once the receiver is connected to the self-leveling detachable base, a mechanical means of achieving independent balance and angular positioning at varying degrees is created. The base is manufactured with the proper weight and proportionate geometric shape(s) necessary to sustain the expandable sustainable member beams' weight and the weight capacities it may encounter from the embodiments' intended uses. Additionally, when the base(s) option is attached to the expandable sustainable member beam, it creates the utility of varying elevational deployment and retracting from varying elevations without the use of a pre-stabilized floor base mechanism. Thereby, allowing the user to let go and have their hands freed for other work. Once deployed, the expandable sustainable member beam can now be used as a table or platform that can be reached from the users' elevation for which to set tools, hardware, etc. Furthermore, the elevation of the expandable sustainable member beam can be easily manipulated to match that of the user. The user can than continue to work from the elevated position without the need to descend to the elevation to manipulate the expandable sustainable member beam to a new elevation.

Additionally, in one embodiment, the beam and the base are created with the capability of being manufactured with perforations and hollow spaces which allows for the attachment of additional said expandable sustainable member beams, other materials, and other tools. Also, the outer most segment(s) can be used to attach various means of enhanced deploying and retracting mechanisms, such as, but not limited to: pneumatic actuator, co2 cartridge, tension spring(s), nitinol steel, magnet(s), pulley(ies) or trolley(ies), etc. Adding the utility of automation; thereby, creating ease in deployment and retraction utilities.

In another embodiment, the created pattern is applied to an elongated trapezoid shape to create the expandable sustainable member beam. In this embodiment the segments' walls consist of perforated flat-bar that make up the corners of the trapezoid walls, while the corresponding walls between the corners are made up of rigid welded wire rods extending in a trapezoid pattern, recited forward in this document as an "X" pattern for simplicity, between the corners of each respective segment wall. The space between the "X" pattern rods remains hollow. The composition of the wall with this hollow space allows this embodiment to receive other like expandable sustainable member beams in a perpendicular fashion, and varying angular degrees, as available, through the hollow spaces. Thus, creating the utility of an expandable sustainable member beam used in conjunction with other like said member beam(s) to provide a means for mechanical support without the conventional method of digging a cavity in the sub-surface in order to pour a concrete pylon; such as, in a post and plumb arrangement. Further eliminating the need for tools, and thus creating: economy in time, economy in labor, and economy in non-sustainable materials. Thereby, creating an expandable sustainable member beam that may be removed and relocated without waste and adding to landfills, thus creating an expandable sustainable member beam that is sustainable.

Further recited in this document is a created perforated flat-bar connectivity system that can be attached to, or manufactured as part of the expandable sustainable member beam, or attached to, or manufactured as part of a conventional beam, or other suitable material. Thus, the perforated flat-bar connection system provides an additional means of attachment and detachment to other like said member beam(s), and or other materials. Thereafter, rendering other beams and materials the opportunity to gain a sustainability factor. Also, created by this embodiment, is an expandable sustainable member beam capable of utilizing outside attachments and storing supplies, such as, but not limited to, magnets, bolts, screws, rivets, hooks, etc.

In another embodiment, again the trapezoid shape is used to create the expandable sustainable member beam. The trapezoid shape, inherent by nature, is a geometric shape of diminishing dimensional values along its' parallelogram sides and lends itself readily to the recited invention. Therefore, the created pattern, process, and method for manufacture starts with manufacturing of the trapezoid shape along predetermined lateral values where as segment(s) are created; thereby, creating segment(s) that will be housed inside one another, as previously recited. This embodiment contains the same created utilities as previously recited, spike(s), and or key(s) to regain rigidity, a mechanical means for which to receive a base, deployment and retraction capabilities from varying elevations, independent balance, an optional base attachment that in one embodiment is capable of independent balance, self-leveling, positional manipulation of varying angular degrees, sub-surface attachment, capable of attachment to other like said member beam(s), and capable of being manufactured with an optional automation enhancement; such as, but not limited to, pneumatic actuator, motor, co2 cartridge, pulley(ies), trolley(ies), etc.

Another embodiment of the invention is an expandable sustainable member beam that is manufactured in plurality, with plural beams sharing a housing segment and platform segment, with an additional option of a miniature expandable sustainable member beam(s), where as to create a handle from which to deploy, recited forward in this document, as a wand(s). The wand(s) creates utility in providing the mechanical means for which to deploy the multiple beams within the housing. This embodiment can be utilized as, but not limited to, a utility stand, or an assistive step for a mobility challenged individual. The segmented rendition of an expandable sustainable member beam utility stand or stepping stool creatively, temporarily decreases the longitudinal and volumic values of a conventional stand or stepping stool; thereby, becoming a stand or stool with an acceptable size to be transported with ease by a persons' hands or in a purse. Enabling a challenged individual more opportunities to carry the device with ease to locations of need. Thereby, rendering it an assistive device with mobility capabilities and sustainable. Additionally, being manufactured with plural beams inside one housing, creates the opportunity for greater weight bearing capabilities and stability when manufactured with specific ratings required for the use. As in the previous embodiments, this embodiment, also contains many of the same created utilities as previously recited, an expandable sustainable member beam(s), spike(s), and or, key(s), opportunity to manufacture with a receiver for a base(s) attachment, an optional created base(s) with independent balance, self-leveling capabilities, positional manipulation at varying angular degrees, deployment and retraction capabilities from varying elevations, and optional automation enhancements.

Another embodiment of the invention is to apply the created pattern, process, and method for manufacture to an irregular elliptic shape; where as varying in dimensional geometric longitudinal values, such as, a water silo or a vase. Again, creating an expandable sustainable member beam from segment(s) of the longitudinal or lateral values of the shape. Thereby, the newly created rendering of the utility, while retracted, becomes a fraction of its' original conventional height, thus creates the economy of mobility compared to that of its' conventional rigid counter part. The segment(s) are manufactured in continued plurality until all segment(s) are created to the size necessary to achieve housing segment(s) with smaller dimensional values inside segment(s) with larger dimensional segment(s). Additionally, the segment(s) are fitted with, but not limited to, and having the freedom of form or material acceptable for liquid containment, a gasket(s), flexible seal(s), or bladder(s), where as to fill the gaps between the variations in circumferences; thereby creating an expandable sustainable member beam with means of liquid containment. Recited forward in this document as a flexible gasket(s). As in the previous embodiments, this embodiment contains the same created pattern for manufacture and gains the same utilities as the previous embodiments of the expandable sustainable member beams, where as spike(s), and or, key(s) are used to regained rigidity while allowing segment(s) to pass uninhibited during deployment, opportunity to manufacture with a receiver for the created base(s), independent balance, self-leveling, positional manipulation of varying angular degrees, deployment and retraction from varying elevations, attachments of other like said member member beams, tools, accessories, and optional automation enhancements.

In another embodiment, the created pattern, process, and method for manufacture is applied to a geometric shape with a convex or void in the lower or upper longitudinal sections of the segment(s) allowing space for portions of the next sequential segment(s) to curve or convex into the available space created by the convex or void. The description of this embodiment will become more apparent when viewing the drawings and reading the section titled, Detailed Description of the Invention, recited forward in this document.

Furthermore, additional embodiments may be manufactured without the self-leveling detachable base, retractability mechanisms, rigidity mechanism, and or other features as appropriate for its' intended use. Thus, embodiments can vary from solid walls allowing for conventional building means of attachments, while other embodiments may be hollow, webbed, framed, etc. Allowing for a means of attachments and or items to pass through the expandable sustainable member beam.

Therefore, the created pattern, process, and method for manufacture, set forth in this document may be applied towards objects of any size and shape to create a new invented rendition of the object that is substantially greater in the attributes than that of its' conventional counter part, such as, economy in mobility, economy in the use of tools needed to adapt a device for usefulness, the economy of skilled labor that might be required in order to use or assemble a device(s) or member beam(s), the economy of blunt force, the economy of connectivity with other like device(s), member beams, tools, accessories, and or with other building materials, and substantially greater sustainability.

BRIEF DESCRIPTION OF DRAWINGS

The drawings, descriptions, components, shapes, materials, and forms, set forth in this document, are intended for representational purposes only, and are provided to enhance clarity of the invention and are not to limit the claims. Furthermore, the drawings are not to scale, and in some cases exaggerated or reduced for clarity. Additionally, not all aspects of each component are illustrated in each drawing to allow space for clarity.

FIG. 4A shows two expandable sustainable member beams 10, in the fully expanded position, and connected together utilizing the perforated flat-bar connection system 19.

FIG. 4B shows a front view of two segments 1, in the expanded position, manufactured with the perforated flat-bar connection system 19, as recited forward in FIG. 4C.

FIG. 4C shows a side view of the top portion of two segments 1, of one embodiment recited in FIG. 4A, manufactured with perforated flat-bar 66, connector spikes 20, rails 21 and a slide-bar 22, just prior to connection; and in brackets, an expanded view of the perforated flat-bar connection system 19; created of: connector spike(s) 20, rail(s) 21, slide bar 22, slope 30, semi-circle sliding nut 31.

FIG. 16 shows two segments 1 with an alternative embodiment to the rigidity mechanism spike(s) or key(s) 2, where as a five sided three dimensional polygon geometric shape are threaded with a lifting cable 48 attached to the inner segment 1 wall with a pin or rivet 42, and threaded through a created hole 47. In the relaxed position the spike(s) or key(s) 2 form a steep slope; thus, allowing for segments 1 to pass uninhibited.

FIG. 16A shows a transparent view of two segments 1 that are in the expanded position with alternative embodiment of the rigidity mechanism spike(s) or key(s) 2, as recited in FIG. 16, where as the spike(s) or key(s) 2 are in the protruding position; thus, providing means of prohibiting reverse motion and creating rigidity among the segments 1. Furthermore, a cross-bar 49 is shown as an alternative mechanism for controlling the spike(s) or key(s) 2.

FIG. 17 shows a transparent view of two segments 1 that are in the expanded position of which an alternative embodiment of the rigidity mechanism spike(s) or key(s) 2, as recited in FIG. 15, where as the spike(s) or key(s) 2 are manufactured with hook(s) 50, flap style tension spring(s) 65, and holding cylinder(s) 52.

FIG. 18 shows a transparent view of two segments 1 that are in the expanded position with an alternative embodiment of the rigidity mechanism spike(s) or key(s) 2, where as the segments 1 are manufactured of perforated flat-bar 66, and are utilized by using a holding pin 53, and a controlling pin 56, are fitted inside a hollow tube 54, and a base spring 58 is attached to the base segment 12; and in brackets, an enlarged view of the rigidity mechanism spikes or keys 2, the holding pin 53, hollow tube 54, inner spring 55, controlling pin 56, controlling cable 57, and base spring 58.

FIG. 19 shows a view of one embodiment of an expandable sustainable member beam 10, fully expanded, where as the segments 1 are manufactured with walls that have severe tapering or cut-outs 59 as a created means to allow curvature of the expandable sustainable member beam 10.

FIG. 19A shows a front view of the expandable sustainable member beam 10, fully expanded, as recited in FIG. 19, in the curved position.

FIG. 19B shows a front view of two expanded segments 1, a rigidity spike or key 2, as recited forward in 19C, and the cut-outs 59.

FIG. 19C shows a transparent 3D enlarged front view of two expanded segments 1, with cut-outs 59, and with an alternative mechanism of the rigidity spike(s) or key(s) 2, where as the walls of the segment(s) 1 are manufactured with catching rods 60, a flexible hook 61, and two curls 62 which can become a single curl 63.

DETAILED DESCRIPTION OF INVENTION

Figure 1:
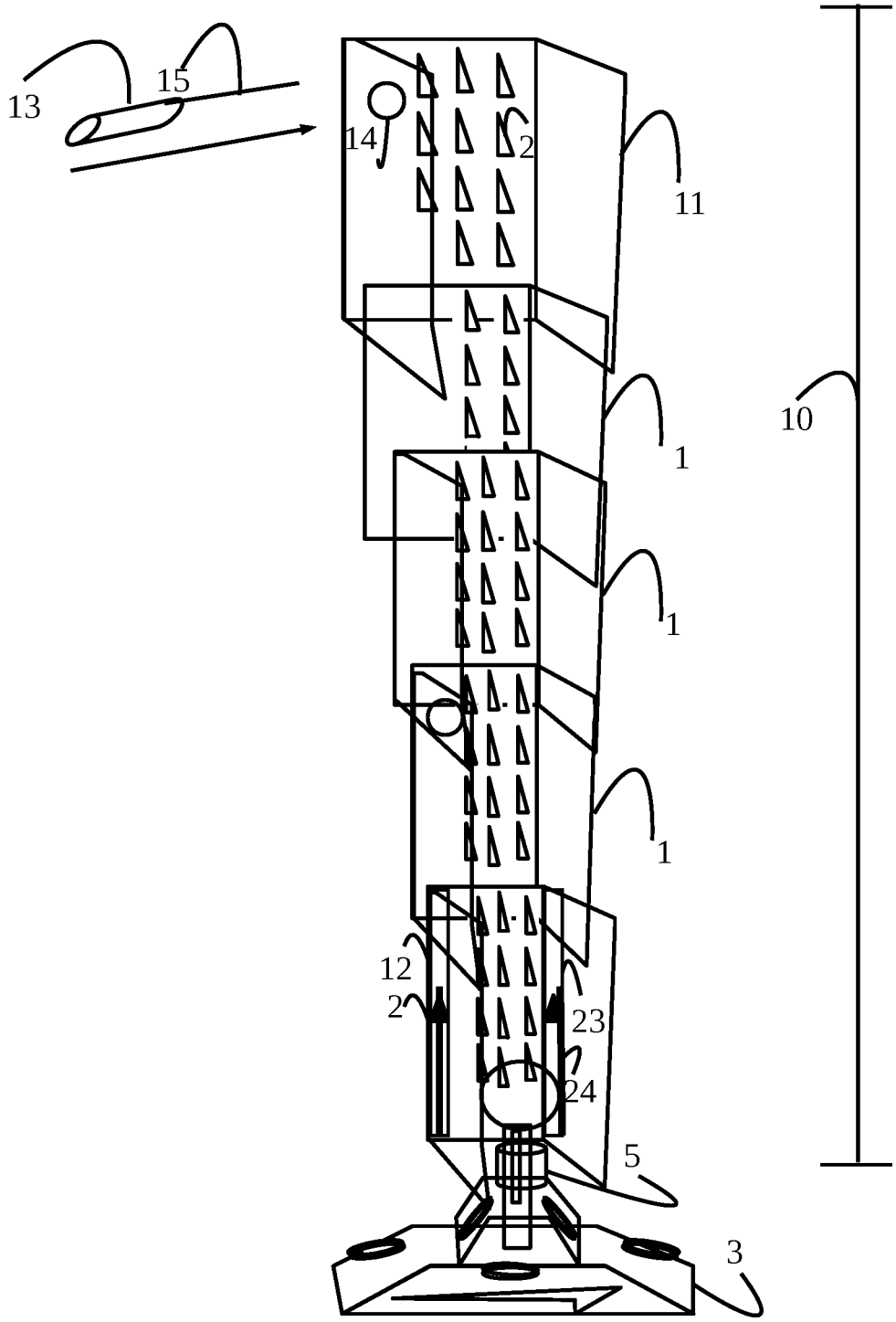
FIG. 1 shows a view of one embodiment of an expandable sustainable member beam 10, where as the self-leveling detachable base 3 is attached. Additionally, shows the rigidity spikes or keys 2, the mounting point 5, the housing segment 11, base segment 12, the holding pin 13, the punched hole 14, the attachment cable 15, the grooves 23, and the puncture rods 24.
Figure 1A:
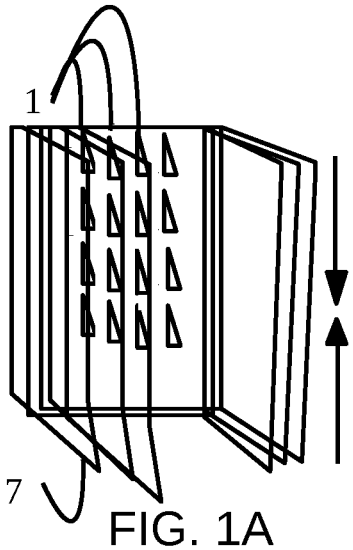
FIG. 1A shows a partially transparent view of three retracted segments 1 of one embodiment, recited in FIG. 1, with the rigidity spikes or keys 2, and the protruding point 7.

FIG. 1A shows a transparent view of one embodiment of the expandable sustainable member beam 10, fully expanded, comprised of several individual segments 1 of diminishing latitudinal values, allowing the segment(s) 1 with smaller latitudinal values to be housed inside the segment(s) 1 with larger latitudinal values. Additionally, FIG. 1A shows a housing segment 11 as being of the same characteristics as segment(s) 1 except with the factor of being the largest latitudinal value. Therefore, the housing segment 11 is the outermost segment 1, that here forward will be recited as the housing segment 11. Also, FIG. 1A shows a base segment 12 as being of the same characteristics as segment(s) 1 with the smallest latitudinal value. Therefore, the inner most segment 1, that here forward will be recited as the base segment 12. Additionally, FIG. 1A shows the expandable sustainable member beam 10 fully expanded and connected to the self-leveling detachable base 3 (recited forward in detail) through the mounting point 5 located in the base segment 12. Furthermore, FIG. 1A shows plural segment(s) 1, housing segment 11, and the base segment 12 as having downward aiming spikes or keys 2 for which to inhibit reverse motion; thereby, causing rigidity between the segments 1, housing segment 11, and the base segment 12. The spike(s) or key(s) 2, are designed to compress towards the segment(s) 1 walls during expansion, thus allowing forward motion of segment(s) 1 and base segment 12; thereby, allowing segment(s) 1 to pass uninhibited, creating a means of expansion. Additionally, the spike(s) or key(s) 2 can be manufactured with varying longitudinal and latitudinal values. Hence, longitudinal values would allow for an overall varying longitudinal value of the expandable sustainable member beam 10; while varying latitudinal values would allow for the varying numbers of spike(s) or key(s) 2 necessary in creating rigidity. Also, shows the punched holes 14 in all segments 1, housing segment 11, and base segment 12, that receives a holding mechanism capable of holding the sum of the segments 1 in the housing segment 11, recited as the connecting pin 13. The connecting pin 13 is attached to the housing segment 11 with an attachment cable 15, such as a wire, but not limited to and having the freedom of any flexible connection; thereby, allowing the connecting pin 13 freedom in movement to engage and disengage from insertion into the punched holes 14 to hold the sum, or any number there of, of the segment(s) 1, and base segment 12 together in the housing segment 11. Additionally, FIG. 1A shows the base segment 12 constructed with grooves 23 in each of the respective corners of the inner walls for which to house ascending puncture rod(s) 24 which may be utilized to puncture a sub-surface when the self-leveling detachable base 3 is not attached. The puncture rod(s) 24 are fitted snuggly into manufactured groove(s) 23 for which the puncture rod(s) 24 press into and remain static by tension until released by user intervention. Furthermore, the groove(s) 23 may be manufactured with indentations or protrusions (not shown) on the inner wall of the groove(s) 23 for which to assist in tension to hold the puncture rod(s) 24 in their housed retracted position, or to assist in stability in there expanded position.

Figure 1B:
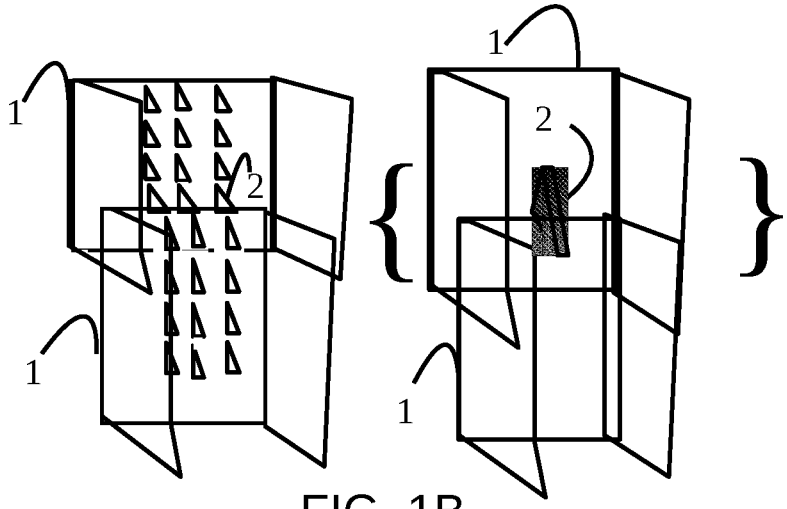
FIG. 1B shows a transparent view of two partially expanded segments 1 of one embodiment, recited in FIG. 1A, where as during expansion, the rigidity spikes or keys 2 allow subsequent segments 1 to pass; and in brackets, an enlarged view of a rigidity spike or key 2 allowing a segment 1 to pass uninhibited.

FIG. 1B shows a transparent retracted view of three segments 1 of one embodiment that is recited in FIG. 1A. Additionally, FIG. 1B shows the three segments 1 manufactured with a protruding point(s) 7 on one of the side walls to illustrate an embodiment of the wall(s), where as the wall(s) of the geometric shape may be manufactured with a protruding point(s) 7 to add the utility of segment(s) 1 wall(s) ability to puncture a sub-surface.

Figure 1C:
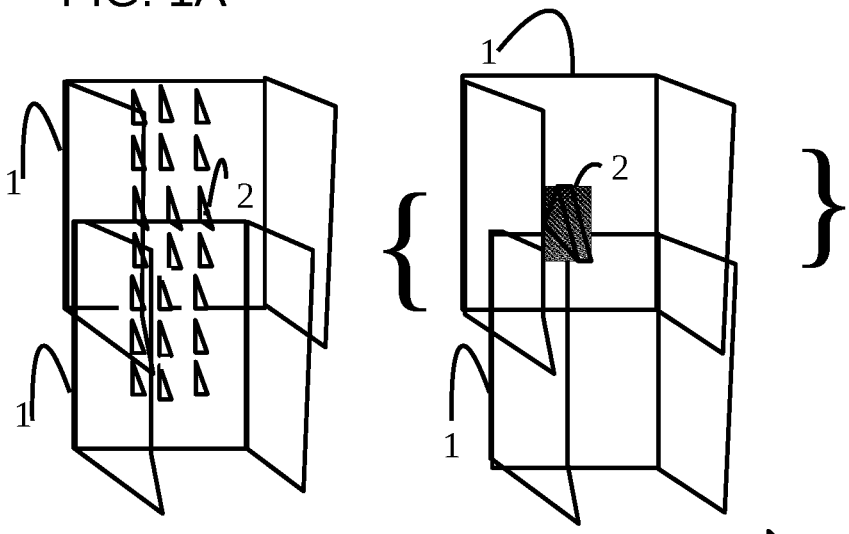
FIG. 1C shows a transparent view of two partially expanded segments 1, of one embodiment recited in FIG. 1A, where as after expansion, the rigidity spikes or keys 2 are prohibiting reverse motion; and an in brackets, an enlarged view of a single spike or key 2 prohibiting reverse motion.

FIG. 1C shows a transparent partially retracted view of two segments 1 of one embodiment recited in FIG. 1A, where as the downward spikes or keys 2 on the first segment 1 are allowing the next subsequent segment 1 to pass uninhibited; and in brackets, a transparent enlarged view of a downward single spike or key 2 as it is being passed by a subsequent segment 1 allowing segment(s) 1 to pass uninhibited during expansion.

Figure 1D:
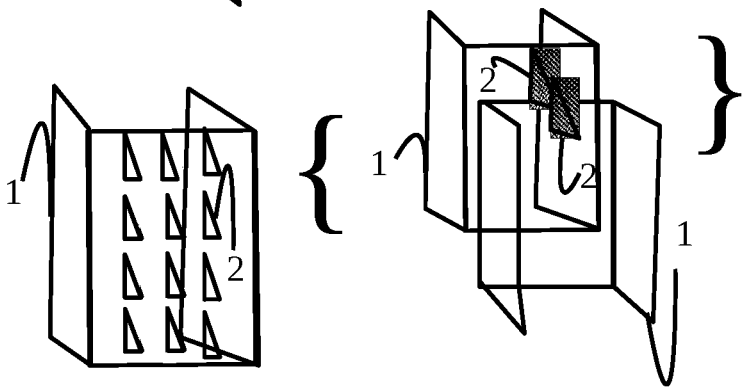
FIG. 1D shows a segment 1 with spikes or keys 2, alternatively manufactured on the exterior wall of the segment 1, as an additional means of connectivity between segment(s) 1; and in brackets, an enlarged view of the exterior spike or key 2 connecting to the interior spike or key 2 of a juxtaposed segment 1.

FIG. 1D shows a transparent view of two partially retracted segments 1 of one embodiment recited in FIG. 1A, where as the downward spike(s) or key(s) 2 on the first segment 1 prohibits the next sequential segment 1 from reverse motion; and in brackets, an expanded view of a single downward spike or key 2 as it is prohibits reverse motion of the next sequential segment 1 causing rigidity.

FIG. 1E shows a segment 1 with spikes or keys 2 manufactured on the exterior wall of the segment 1 creating an additional means of connectivity between like said expandable sustainable member beams 10; and in brackets, shows an expanded view of a single exterior spike or key 2 illustrated for clarity, where as the exterior spike or key 2 is fitted into a single interior spike or key 2.

Figure 2:
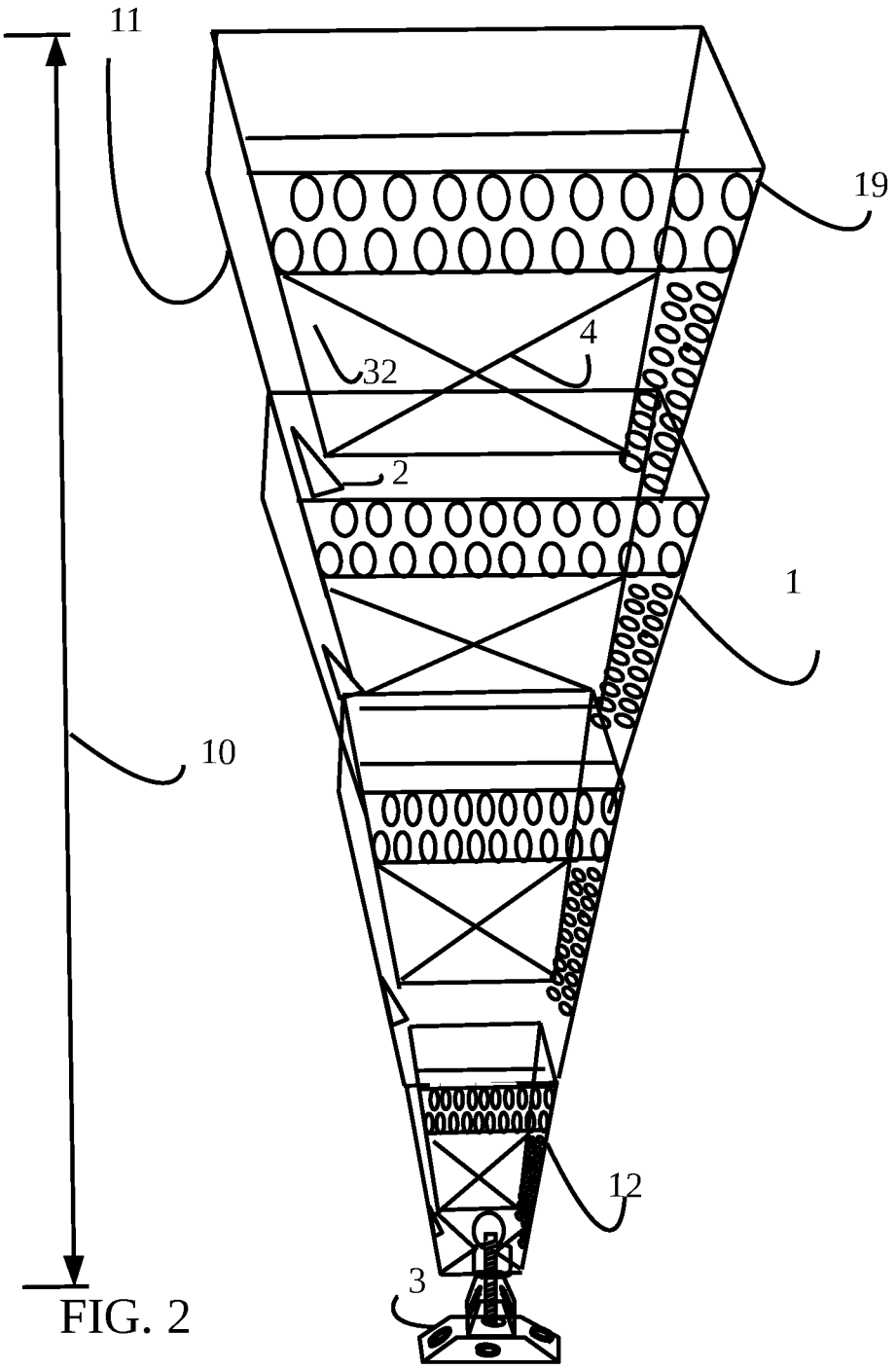
FIG. 2 shows the view of one embodiment of an expandable sustainable member beam 10, in the fully expanded position, where as the segments 1 are manufactured of a four sided trapezoid shape with hollow spaces 32 between the rods 4, the flat-bar connection system 19, the rigidity spikes or keys 2, the housing segment 11, and the self-leveling detachable base 3, as attached to the base segment 12.

FIG. 2 shows the view of one embodiment of the expandable sustainable member beam 10, fully expanded, where as manufactured of a four sided trapezoid shape, with the housing segment 11 and with the self-leveling detachable base 3 attached to the base segment 12. In this embodiment the majority of the segment 1 walls are hollow spaces 32, and the frame of the segment 1 walls are constructed of rigid rods 4 supported by corners, manufactured of the perforated flat-bar connection system 19, recited forward in this document. Rods 4 would be appropriately shaped and arranged, according to the embodiment, in a fashion in order to receive other like expandable sustainable member beam(s) 10 in the hollow spaces, 32 such as a deformed rod in a trapezoid shape or "X" shape, where as the respective ends leading out toward and attached to the four corners of a segment 1 wall would allow for the particular embodiment to receive a like embodiment in the hollow spaces 32. (Recited in this document as an "X" shape for simplicity). Additionally, the inner walls of the segments 1 are manufactured with spike(s) or key(s) 2 that will be recited forward in this document.

Figure 3A:
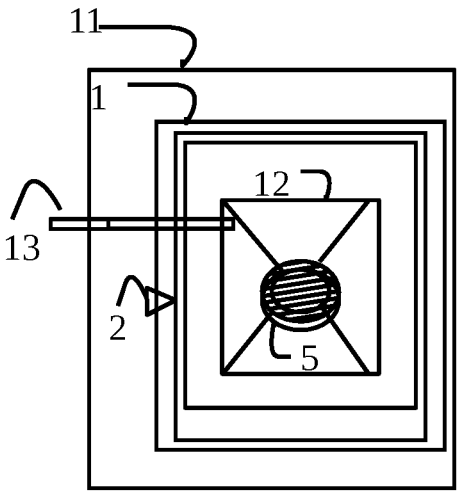
FIG. 3A shows a satellite view of several segments 1 in the retracted position, of one embodiment as recited in FIG. 2, the housing segment 11, the base segment 12, rigidity spike or key 2, mounting point 5, and the connecting pin 13.

FIG. 3A shows a satellite view of several retracted segments 1 of one embodiment, where as manufactured of the housing segment 11, the self-leveling detachable base 3, base segment 12 with the mount point 5, the rigidity spike or key 2 and the connecting pin 13.

Figure 3B:
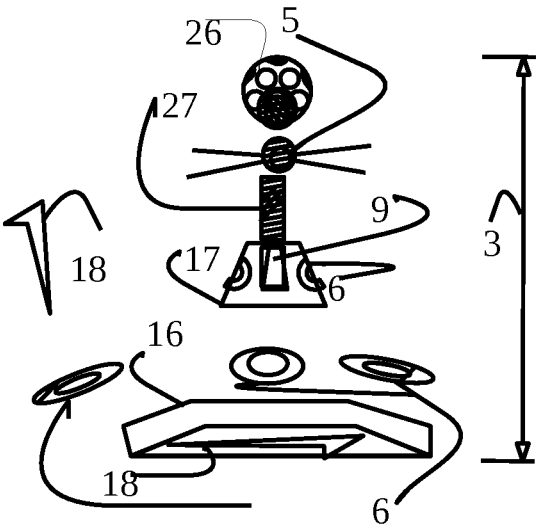
FIG. 3B shows an expanded view of the components of the self-leveling detachable base 3; created of: the mount point 5, threaded holes 6, receiving cylinder 9, southern trapezoid 16, northern trapezoid 17, stake 18, ball nut 26, and threaded rod 27.

FIG. 3B shows an expanded view of one embodiment of the self-leveling detachable base 3 which is manufactured of the southern most three dimensional trapezoid portion 16, constructed of light gauge steel, but having the freedom of any assembled, molded, or pressed rigid material, such as, steel, plastic, wood, etc., the northern most three dimensional trapezoid portion 17, constructed of light gauge steel, but having the freedom of rigid material, such as; steel, plastic, wood, etc., the mounting point 5 which is manufactured with an inner nut having several smooth rods affixed to the nut expanding outward towards and attachable to the inner wall(s) of the base segment 12, as recited in FIG. 3A, the threaded holes 6 located in the southern and northern most trapezoid portions 16 and 17 respectively, the connecting threaded rod 27, the threaded receiving cylinder 9, located with the northern most trapezoid portion 16, the threaded perforated ball-nut 26, manufactured un-affixed, where as the connecting threaded rod 27 threads into the self-leveling detachable base 3 on one end, while the other end threads through the mounting point 5, and thereafter, into the threaded perforated ball-nut 26. Thereby, joining the self-leveling detachable base 3 through the base segment 12, as recited in FIG. 3C. The threaded holes 6 are provided to add utility, where as each of the threaded holes 6 provides a hollow space within the self-leveling detachable base 3 for which to receive additional expandable sustainable member beam(s) 10, accessories such as stake(s) 18, or relocating the self-leveling detachable base 3 from the threaded receiving cylinder 9 to one of the threaded holes 6. Furthermore, the detachable stake(s) 18 is housed on the self-leveling detachable base 3 and is provided to use in the threaded holes 6 alone, or in conjunction with the perforated ball-nut 26, to stabilize the self-leveling detachable base 3 to a sub-surface or a like additional expandable sustainable member beam(s) 10, as recited in FIG. 6C.

Figure 3C:
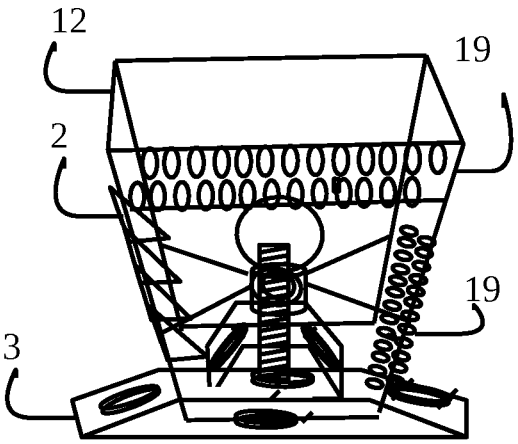
FIG. 3C shows a transparent front view of the self-leveling detachable base 3, as attached to the smallest inner most base segment 12, in a retracted state of one embodiment illustrated in FIG. 3A; also, showing the rigidity spikes or keys 2 and the flat-bar connection system 19.

FIG. 3C shows a transparent view of the self-leveling detachable base 3, as attached to the smallest inner most base segment 12, in its' retracted state, as recited in FIG. 3A. Additionally, shows the perforated flat-bar connecting system 19 and the rigidity spikes or keys 2.

Figure 3D:
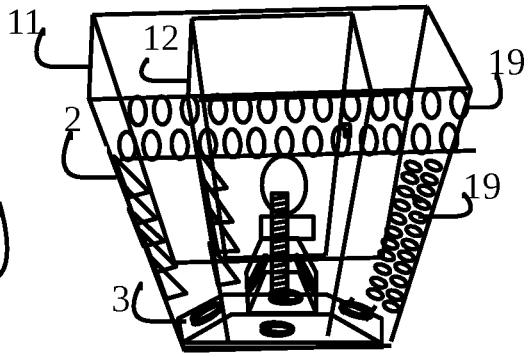
FIG. 3D shows transparent front view of the self-leveling detachable base 3, as attached to the smallest inner most base segment 12, and the outer most housing segment 11, in its' retracted position of one embodiment recited in FIG. 3A; also, showing the rigidity spikes or keys 2, and the perforated flat-bar connection system 19.
Figure 5:
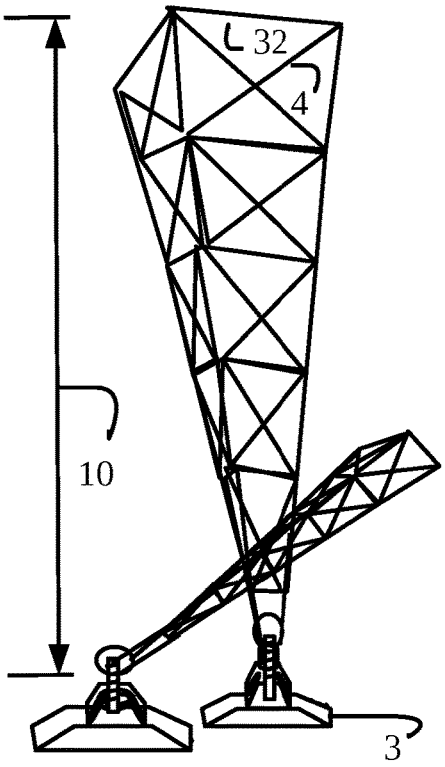
FIG. 5 shows a view of one embodiment of two expandable sustainable member beams 10, fully expanded, where as they are utilized together on varying topography elevations; also shows, rods 4, hollow spaces 32, and the respective self-leveling detachable bases 3.
Figure 5A:
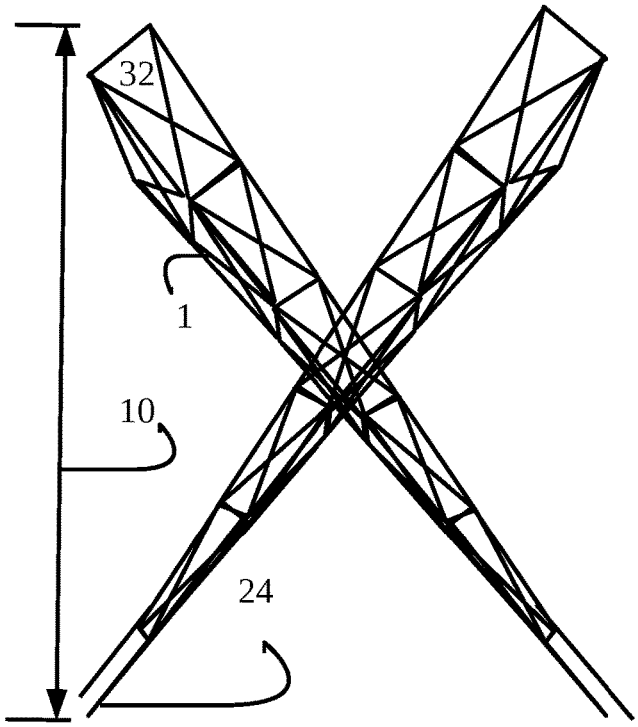
FIG. 5A shows a view of one embodiment of two expandable sustainable member beams 10, fully expanded, and utilized as cross beams on similar topography elevations; where as, the segments 1 are manufactured with rods 4, and hollow spaces 32. Additionally, shows the puncture rods 24.

FIG. 3D shows a frontal transparent view of the self-leveling detachable base 3, as attached to the smallest inner most base segment 12, and the outer most housing segment 11, in their retracted position, of one embodiment recited in FIG. 5A. Additionally, shows the perforated flat-bar connection system 19, and the rigidity spikes or keys 2.

FIG. 4A shows two expandable sustainable member beams 10, fully expanded, connected together utilizing the perforated flat-bar connection system 19, as explained forward in FIG. 4C.

FIG. 4B shows a front view of two segments 1, in the expanded position, constructed with the perforated flat-bar connection system 19, as recited forward in FIG. 4C.

FIG. 4C shows a side view of the top portions of two partial segments 1 of one embodiment, recited in FIG. 4A, just prior to connection, where as the corners of the northern most edge of the segment 1 walls are manufactured of the perforated flat-bar connection system 19. The perforated flat-bar connection system 19 is manufactured of the connector spike(s) 20, and a slide bar(s) 22, attached to the rail(s) 21. The segments 1 are places in juxtaposed positions. The slide bar(s) 22 of one segment 1 is pushed aside in order to receive the connector spike(s) 20 of the opposing segment 1. The connector spike(s) 20 slide upward on the rail(s) 21, allowing them to extend away from the segment 1 and thread through the perforated flat-bar 66 of the opposing segment 1. Once the connector spike(s) 20 are threaded into the opposing segment 1, the slide bar(s) 22, from the first segment 1, is pushed back over the rail(s) 21, thus locking the connector spike(s) 20 and connecting the segments 1; and in brackets, shows an enlarged detailed view of the major components of the perforated flat-bar connection system 19, where as the perforated flat-bar(s) 66 are manufactured of, but not limited to, a rigid material, such as, steel, plastic, aluminum, wood, etc. The perforations are manufactured with a slope(s) 30 pressed into the flat-bar leading up to the hollow perforation(s), as to aid in guiding the connector spike(s) 20 upward, which are manufactured of, but not limited to, deformed rod and located on rail(s) 21 inside the perforated flat-bar connection system 19. When the user intervenes by pushing the semi-circle sliding nut(s) 31 along the rail(s) 21 in a latitudinal direction, the connector spike(s) 20 are pushed up through the slopes 30 and into the hollow perforations of the perforated flat-bar(s) 66. The connector spike(s)' 20 position becomes upright and perpendicular to the segment(s) 1 allowing the connector spike(s) 20 to then be threaded by the user into the perforated flat-bar(s) 66 of a second expandable sustainable member beam 10. Thus, connecting the two expandable sustainable member beams 10. Also, connected to the rail(s) 21 is a slide bar(s) 22; once the connector spike(s) 20 from the first member beam 10 are threaded into a second member beam 10, the user pushes the slide bar(s) 22 in front of the connector spike(s) 20 locking the connector spike(s) 20 in position. When release of the connection is desired, the user intervenes, and pulls the slide bar(s) 22 in a reverse latitudinal motion away from the connector spike(s) 20. Thus, releasing the lock and disconnection of the connector spike(s) 20 is now possible.

FIG. 5 shows a view of one embodiment of two expandable sustainable member beams 10, fully expanded, with the respective self-leveling detachable bases 3 being utilized together on varying topography elevations; where as, one expandable sustainable member beam 10 is used as a post and the second expandable sustainable member beam 10 with equal or smaller volumic values is inserted into the hollow spaces 32 between the rods 4 of a segment 1 wall of the first expandable sustainable member beam 10 allowing it to be attached to the self-leveling detachable base 3 or a sub-surface. Thus, creating a plumb support for the first expandable sustainable member beam 10.

FIG. 5A shows a view of one embodiment of two expandable sustainable member beams 10, fully expanded, being utilized as a means of cross beam support. By inserting the first expandable sustainable member beam 10 at degreed angles into the hollow spaces 32 of a segments' 1 walls of the second expandable sustainable member beam 10, a cross beam support mechanism is created. Additionally, showing the ascending puncture rods 24 in the fully expanded positions, which can be inserted into a sub-surface for stabilization.

Figure 5B:
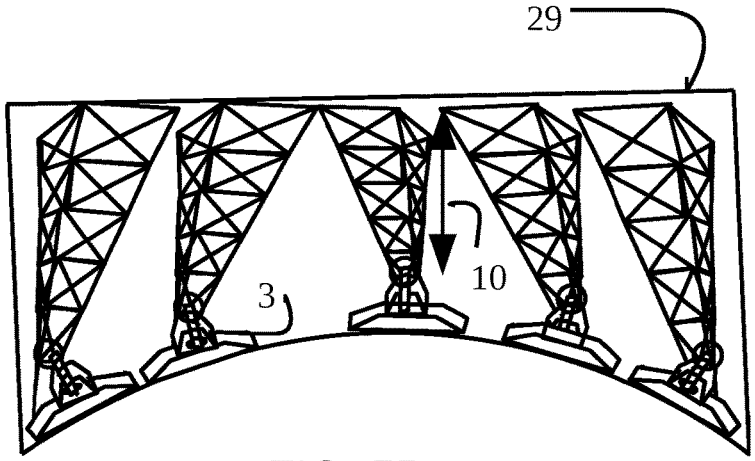
FIG. 5B shows one embodiment of five expandable sustainable member beams 10, utilized together with five respective self-leveling detachable bases 3, where as to create an arch, of which has a skin 29 attached.

FIG. 5B shows one embodiment of five expandable sustainable member beams 10, utilized together with the respective self-leveling detachable bases 3, arranged at degreed angles to create an arch. Also, shows the expandable sustainable member beams 10 with a solid surface skin 29 attached, as recited forward in FIG. 6C.

Figure 5C:
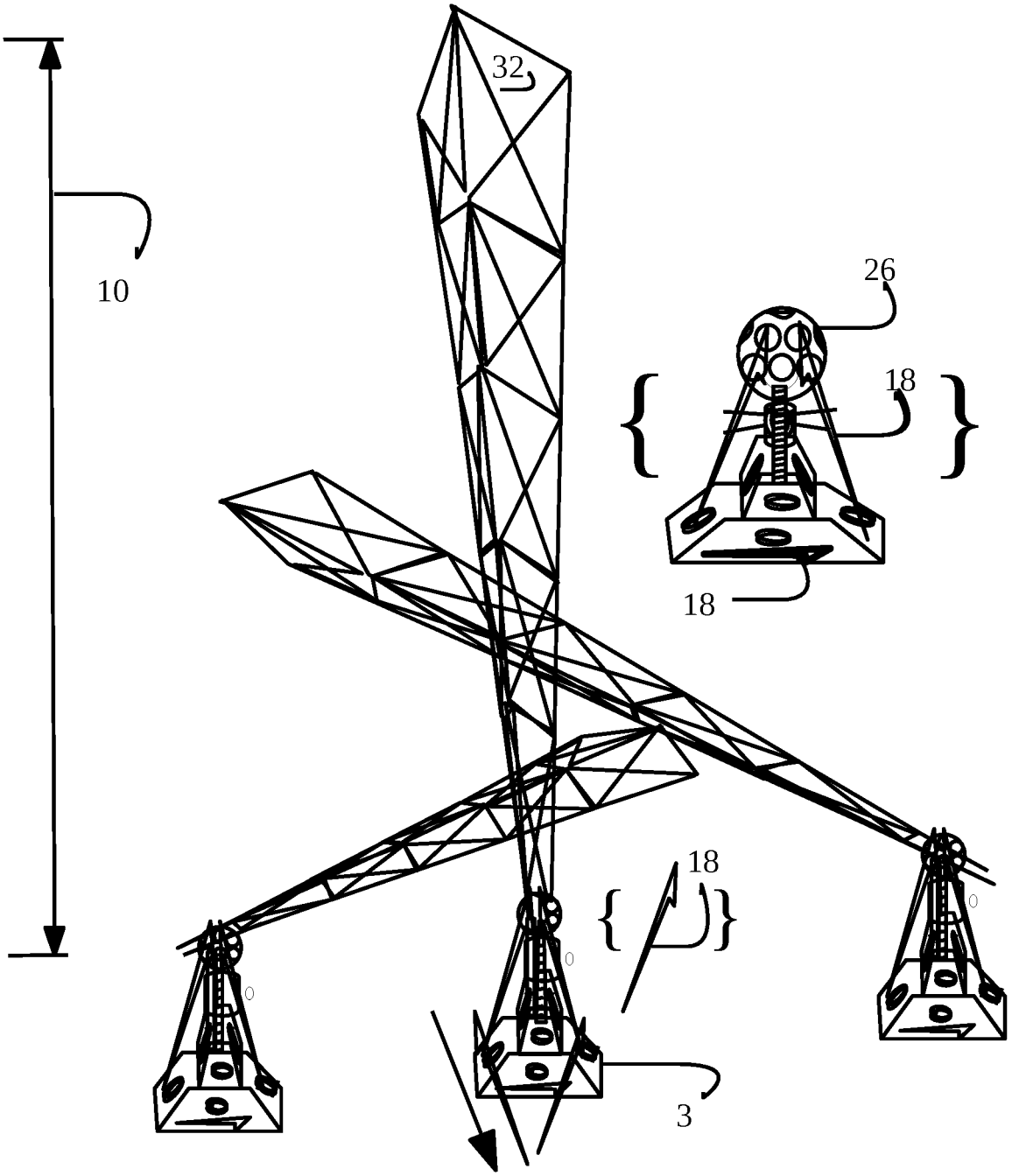
FIG. 5C shows one embodiment of three expandable sustainable member beams 10, with the respective self-leveling detachable bases 3 attached, where as they are utilized as a post and two plumbs; and in brackets, the self-leveling detachable base 3 with the stake 18 attachment utilized in the ball-nut 26.

FIG. 5C shows a view of one embodiment of three expandable sustainable beams 10, fully expanded, represented in two different sizes. One larger expandable sustainable member beam 10 and two smaller expandable sustainable beams 10, each with the respective self-leveling detachable bases 3 attached. All three expandable sustainable member beams 10 are being utilized together as a post and two plumbs. The larger embodiment of the expandable sustainable member beam 10 is positioned longitudinally creating a post and the two smaller expandable sustainable member beams 10 are positioned at degreed angles that are inserted into the hollow spaces 32 of two separate segments 1; thereby, creating means of support. Also showing, the detachable stakes 18 being utilized as inserted into the perforated holes of the ball-nut 26, as means of creating additional stability of the angle between the self-leveling detachable bases 3 and the expandable sustainable member beam 10. This illustration, further demonstrates the utility of expandable sustainable member beams 10 of having means of stability while spanning varying elevations of topography; also, showing on the largest member beam 10, the self-leveling detachable base 3, utilizing the detachable stakes 18 accessory, as inserted in the threaded holes 6 and sub-surface to create stability between the expandable sustainable member beams 10 and the sub-surface; and, in two sets of brackets: I. A transparent enlarged view of the detachable stakes 18, as inserted into the self-leveling detachable base 3, and the perforated ball-nut 26. II. An enlarged view of the stake 18.

Figure 6:
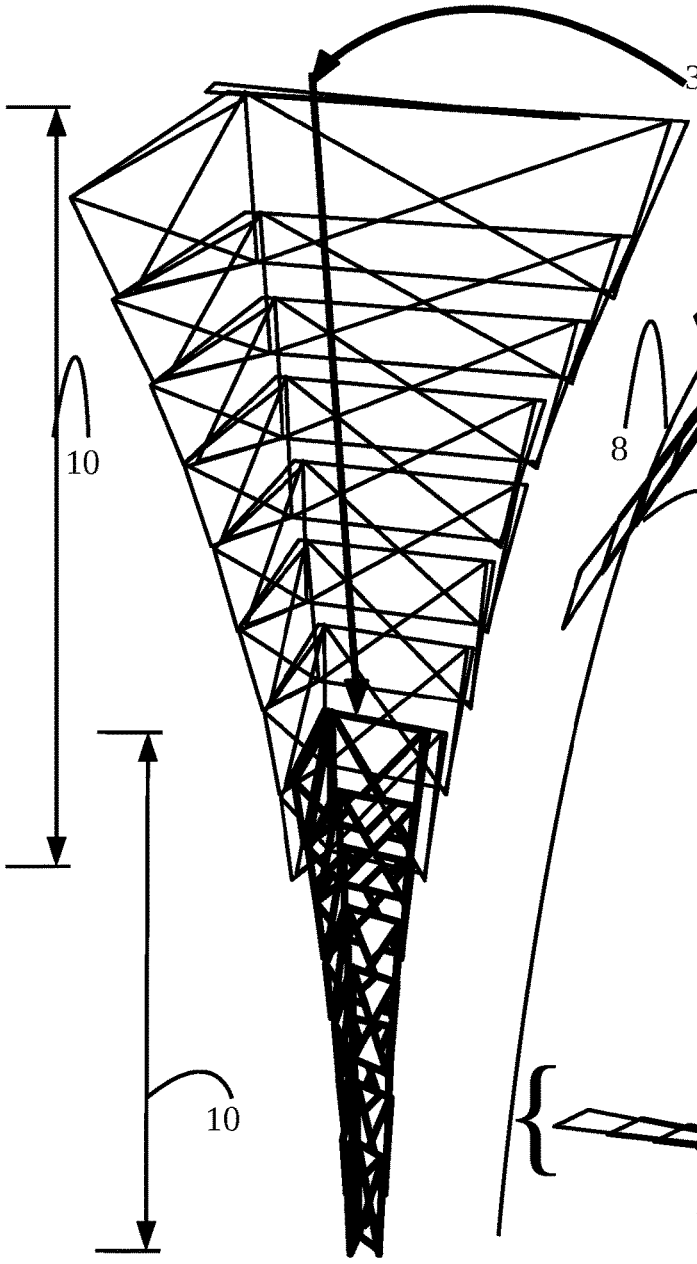
FIG. 6 shows a view of one embodiment of two expandable sustainable member beams 10, fully expanded, manufactured of welded wire, where as one beam, being manufactured with appropriately smaller dimensional values than the other beam, as necessary to fit into the cavity 34 of the other beam; thereby creating the utility of a post and ground stake for sub-surface attachment replacing a conventional post and pylon.

FIG. 6 shows a transparent view of one embodiment of two expandable sustainable member beams 10, fully expanded, where as one embodiment of the expandable sustainable member beam 10, (illustrated in bold line) is manufactured with a smaller volumic value, that of which is necessary to fit inside the former, and is utilized as a ground stake or pylon, and is inserted into the cavity 34 of the larger embodiment of the member beam 10, and subsequently a sub-surface. Thus, creating means of attachment and support of the first expandable sustainable member beam 10 to the sub-surface. Additionally, creating economy in labor by eliminating the conventional practice of an individual digging a space into the sub-surface and pouring concrete to establish support. Also, creating utility in economy of tools and material required to achieve support to a sub-surface.

Figure 6A:
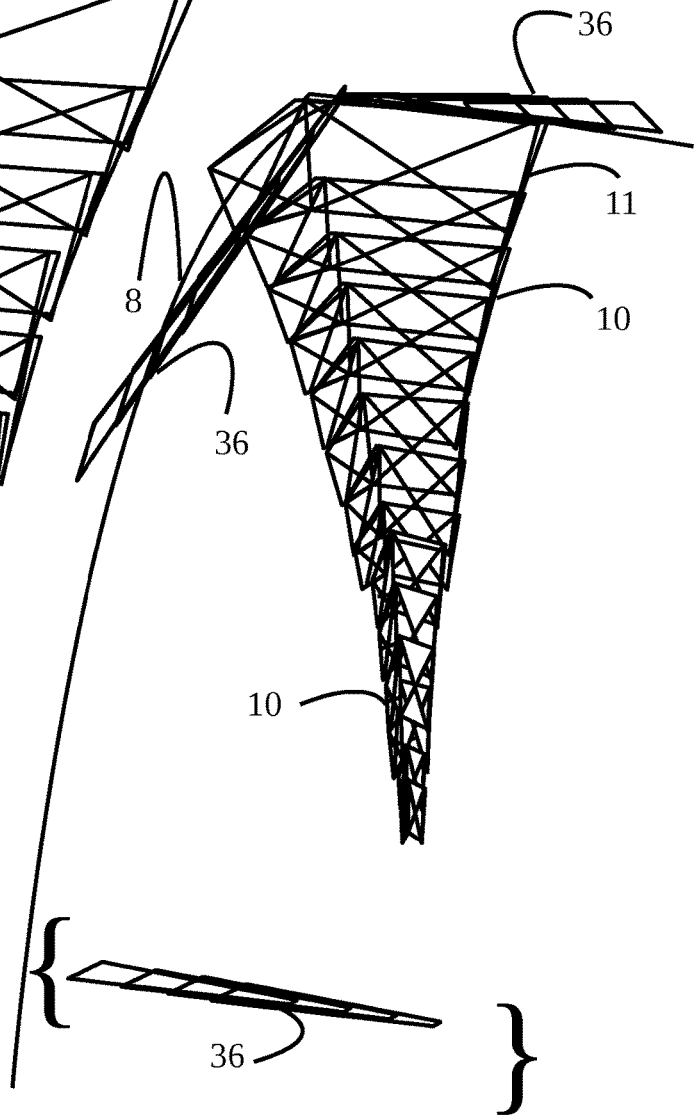
FIG. 6A shows a view of one embodiment of four expandable sustainable member beams 10, where as two of the beams are utilized to form a post and stake, as recited in FIG. 6, and the housing segment 11 is fitted with significantly smaller beams utilized in an umbrellic fashion, recited as wand(s) 36, of which to drape material 8; and in brackets, an enlarged view of a wand 36.

FIG. 6A shows a front view of one embodiment, as recited in FIG. 6, where as additional expandable sustainable member beams 10 are manufactured with a significantly smaller volumic value of an expandable sustainable member beam 10 attached to, but not limited to, the housing segment 11, to be utilized as a wand(s) 36. The expanded wand(s) 36 creates a frame work for which a flexible material 8 can be draped. Thereby, creating a temporary private space or shelter behind the flexible material 8. Furthermore, segments 1 may be manufactured with a clip (not shown) for which to store the wand(s) 36 when not in use; and in brackets, shows an enlarged view of the wand(s) 36.

Figure 6B:
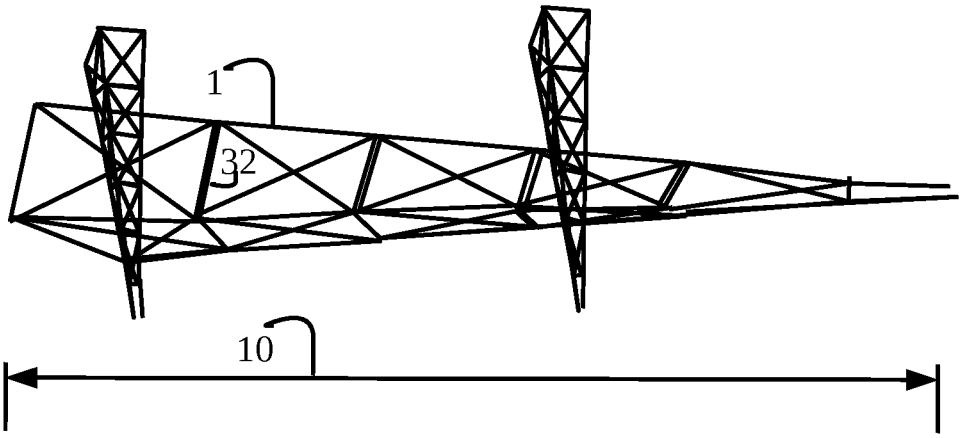
FIG. 6B shows a view of the embodiment described in FIG. 6, where as the horizontal position of one of the expandable sustainable member beam 10, and the beams 10 with smaller dimensional values are inserted into the hollow spaces 32 to be utilized as cross bars to create, but not limited to, a frame form for concrete reinforcement.

FIG. 6B shows a view of one embodiment of three expandable sustainable member beams 10, fully expanded, where one expandable sustainable member beam 10 is utilized in a lateral position on a surface, and two smaller expandable sustainable member beams 10 are inserted in a longitudinal position into the hollow spaces 32. Thereby, creating the utility of the expandable sustainable member beam(s) 10 used as cross bars to create, but not limited to, a frame form for concrete reinforcement.

Illustrating the expandable sustainable member beam 10 capability of being utilized alone, or in conjunction with a like expandable sustainable member beams 10; where as, to create utility of a pre-assembled structure or form frame work, which might be used as, but not limited to, a structural reinforcement for concrete. Thus, eliminating the need for the hauling of conventional re-bar, with a large longitudinal value, and eliminating the labor intense practice of re-bar tying.

Figure 6C:
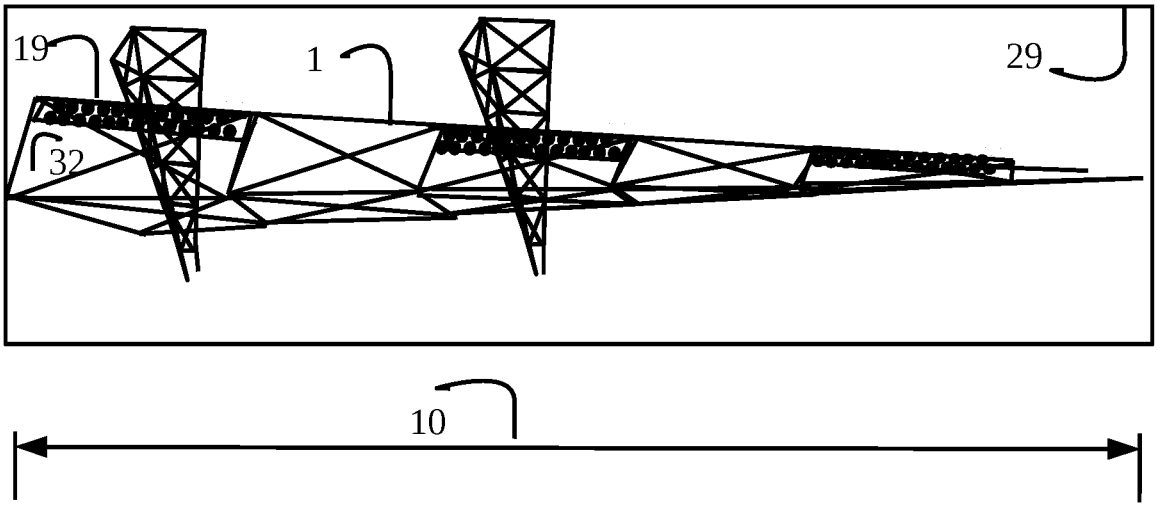
FIG. 6C shows a view of the embodiment described in FIG. 6B, where as the segments 1 of the expandable sustainable member beam 10 are manufactured with the perforated flat-bar connection system 19, hollow spaces 32, and rods 4; also, shows a skin 29 attachment utilized as sheeting to create a solid surface on the frame form to create a framing for concrete pours.

FIG. 6C shows a view, as recited in FIG. 6B, where as the addition of a skin 29 is added to create the utility of solid sheeting to a form frame work. Thus, creating many uses in the construction industry, such as, but not limited to: framing for concrete work, framing for walls, framing for barricades, etc. Also, illustrated in this view is the perforated flat-bar connection system 19.

Figure 6D:
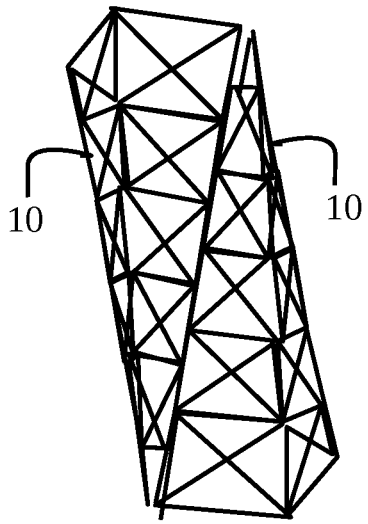
FIG. 6D shows a view of one embodiment, where as two expandable sustainable member beams 10 are utilized in juxtaposed positions.

FIG. 6D shows one embodiment of two expandable sustainable member beams 10, where as the expandable sustainable member beams 10 are constructed with the dimensional values required to line up next to each other to facilitate a juxtaposed position. The two expandable sustainable member beams 10 are utilized side by side, where as one expandable sustainable member beam 10 is positioned upside down and one expandable sustainable member beam 10 is positioned right side up. The beams are connected through magnetized material, but not limited to, and having the freedom of various means of connection. Thereby, two expandable sustainable member beams 10 connected to create a single laminate expandable sustainable member beam 10 with a larger overall dimensional value.

Figure 6E:
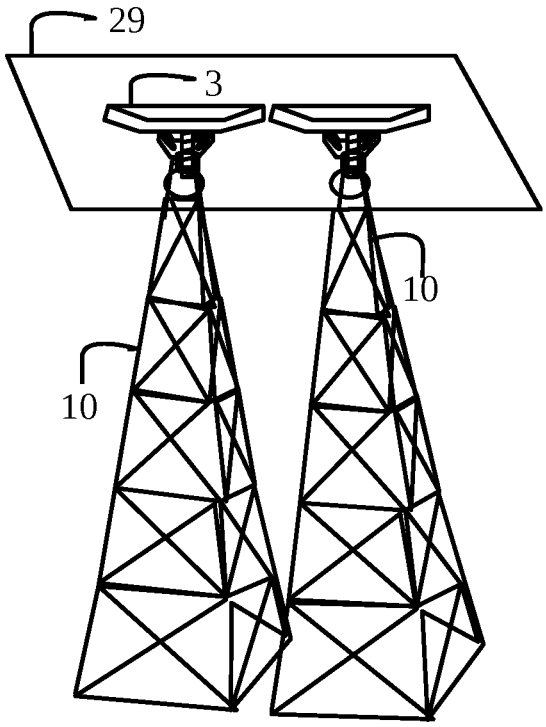
FIG. 6E shows a view of one embodiment, where as two expandable sustainable member beams 10 are utilized upside down with the respective self-leveling detachable bases 3 attached, and a skin 29 is utilized as sheeting to create a platform or works space.

FIG. 6E shows one embodiment of two expandable sustainable member beams 10 utilized upside down in a longitudinal position with the respective self-leveling detachable bases 3 attached, where as to support a solid surface skin 29 as means to create, but not limited to: a table top or work surface. Thereby, creating the utility of an elevated work surface, utility stand or saw horse.

Figure 6F:
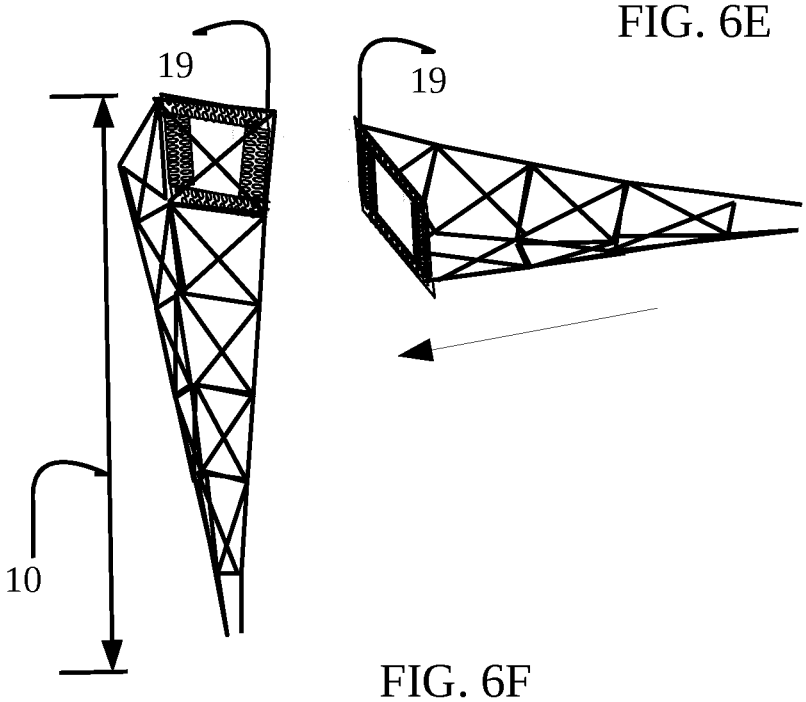
FIG. 6F shows a view of one embodiment, where as two expandable sustainable member beams 10 are utilized as a post and beam, utilizing an alternative embodiment to the perforated flat-bar connection system 19.

FIG. 6F shows the fully expanded version of one embodiment of two expandable sustainable member beams 10, where as one expandable sustainable member beam 10 is utilized as a post and is perpendicular to the surface of another expandable sustainable member beam 10 which is being utilized as an elevated beam. Also, shows an alternative embodiment of the perforated flat-bar connection system 19 as a means of connection.

Figure 7A:
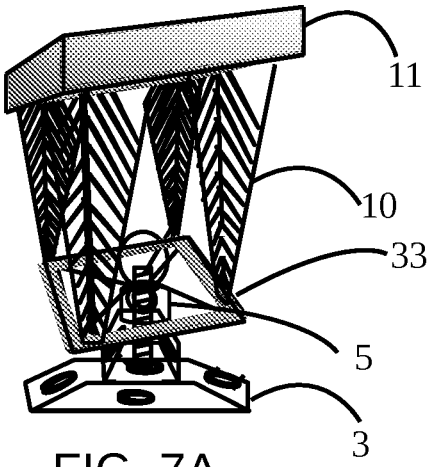
FIG. 7A shows the fully expanded version of one embodiment, where as several expandable sustainable member beams 10 are manufactured on a platform 33 and in a housing container 11 which can be connected to the self-leveling detachable base(s) 3 through the mounting point 5.

FIG. 7A shows the fully expanded version of one embodiment, where as several expandable sustainable member beams 10 are constructed on a platform 33, and the housing segment 11 is a housing container which is manufactured as a separate component vs being the outer most segment 1 of an individual expandable sustainable member beam 10. The platform 33 is manufactured with the mounting point 5, as recited in 7B. Thereby, allowing connection of the self-leveling detachable base 3. Thus, creating the utility of plurality of expandable sustainable member beams 10 sharing the same platform 33 to create pre-assembled stability.

Figure 7B:
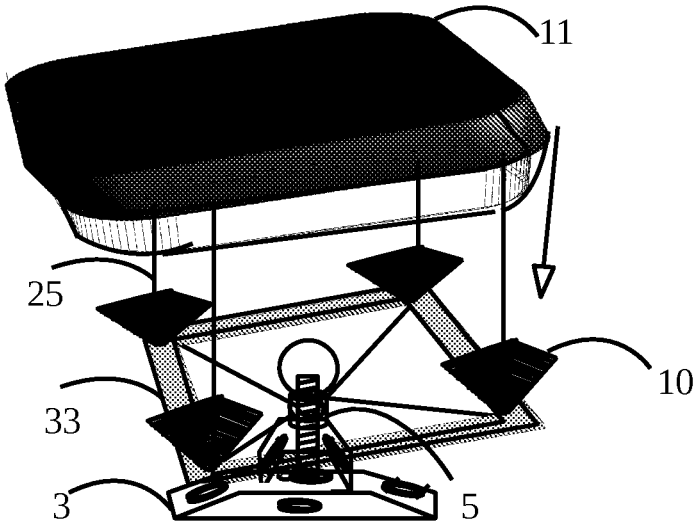
FIG. 7B shows a partially expanded view of a fully retracted version of the one embodiment referenced in FIG. 7A, where as several expandable sustainable member beams 10 are manufactured on a platform 33 and in a housing container 11, connected to the self-leveling detachable base 3 through the mounting point 5, and the deployment and retraction mechanism is a cable 25.

FIG. 7B shows a partially expanded view of a fully retracted version of one embodiment, as recited in FIG. 7A; where as plural expandable sustainable member beams 10 are manufactured sharing a single platform 33. Additionally, shows a means of an expandable and retractable mechanism attached to the housing container 11 and the platform 33, recited as a cable 25, but not limited to, and having the freedom of other retractable mechanisms.

Figure 7C:
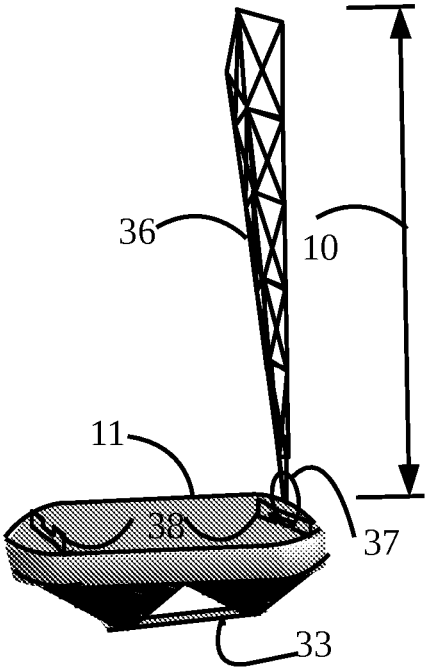
FIG. 7C show a fully expanded version of the one embodiment referenced in FIG. 7A, where as the expandable sustainable member beams 10 are manufactured in plurality on a platform 33 and in a housing container 11 which is manufactured with a significantly smaller expandable sustainable member beam 10 connected to the roof to be used as a handle, recited as a wand 36, with the means of connection to the housing container 11 being that of a ring 37 and clips 38.

FIG. 7C shows a fully expanded version of one embodiment, recited in FIG. 7A, where as the housing container 11 is manufactured with an additional expandable sustainable member beam 10 that is significantly smaller in latitudinal and longitudinal dimensions to be utilized as a wand(s) 36. The wand(s) 36 is manufactured with a ring 37 and attached to the smallest segment 1 of the wand(s) 36 of which attaches to the roof of the housing container 11. The ring 37 may be attached to the roof of the housing container 11 in the following manner, but not limited too, a three sided bar affixed to the roof of the housing container 11 with the open side affixed towards the solid roof of the housing container 11, where as the two parallel sides of the bar are affixed creating a solid enclosure of which the ring 37 is inserted. Thereby, the wand 36 is attached by a means in which allows the wand(s) 36 to have varying angular degrees of movement including perpendicular to the roof of the housing container 11, while remaining attached to the roof of the housing container 11. The three sided bar is created in a size appropriately proportioned in relation to the roof of the housing container 11. The ring 37 and the wand 36 are manufactured with, but not limited to, proportionality to allow for the wand 36 to extend until the utensil has reached to the desired elevation while the user remains in a full upright position. Additionally, the wand(s) 36 may be manufactured with an additional clip 38 that holds the wand(s) 36 in a desired position. Thereby, creating the utility of a stepping stool or other utility device having means of deployment from varying elevations. Also, illustrated in the embodiment is the roof of the housing container 11, manufactured with a clip 38 for which to secure the wand 36 when retracted and not in use. The clip 38 may be manufactured with, but not limited to, a three sided bar and attached to roof of the housing container 11 with the open end facing up and away from the housing container 11 and located on the opposite side of the three sided bar that holds the ring 37 and wand 36. Also, showing the platform 33. Additionally, this embodiment, but not limited too, and having the freedom of embodiment, when scaled to the appropriate height, width, and tinsel strength, effectively creates an apparatus of utility with means of weight bearing capabilities.

Figure 7D:
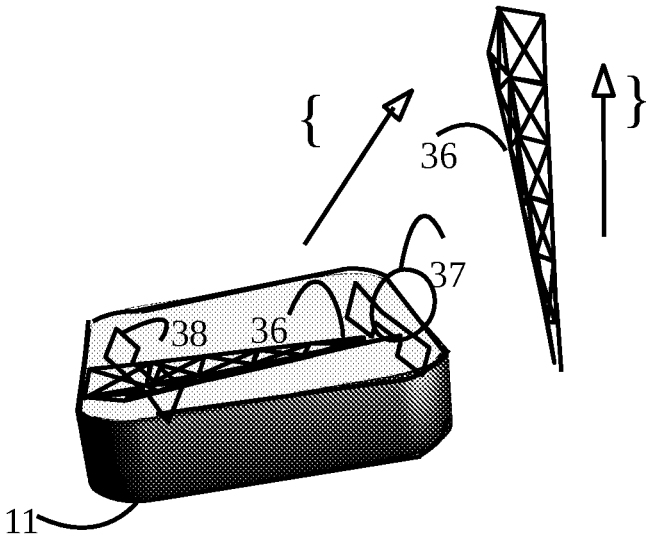
FIG. 7D shows a view of the embodiment referenced in FIG. 7C, where as the wand 36 is shown in both positions: on the housing segment 11, connected by the ring 37, and clips 38; and in brackets, a fully expanded wand 36 extended in a perpendicular position.

FIG. 7D shows a fully retracted version of the embodiment recited in FIG. 7C, where as the wand 36 is illustrated in both its' retracted stored position as attached to the housing container 11 with the clip 38 and the ring 37; and in brackets, the wand 36, in its' expanded position.

Figure 8:
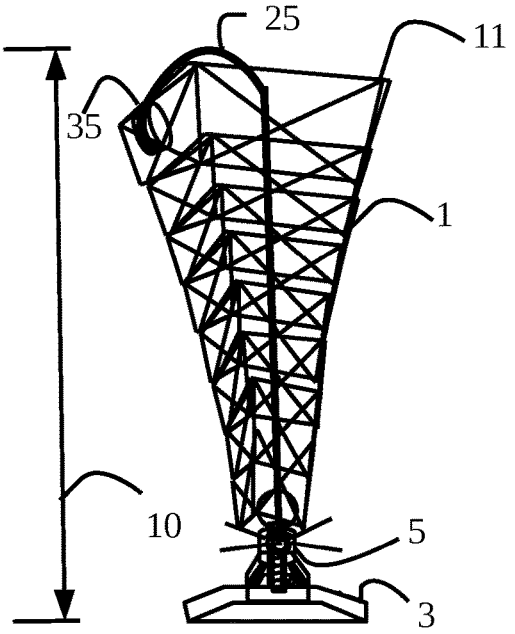
FIG. 8 shows one embodiment of the expandable sustainable member beam 10, fully expanded, with the self-leveling detachable base 3, where as a pulley 35 and cable 25, are attached to the housing segment 11, and is connected to the mounting point 5, and are together being utilized as a deployment and retraction mechanism.

FIG. 8 shows one embodiment of an expandable sustainable member beam 10, fully expanded, where as the housing segment 11 is manufactured with, but not limited to, a cable 25 (illustrated in bold line) and a pulley 35, as a mechanism for expansion and retraction. The cable 25 is connected to the mount point 5. Also, showing in this illustration is the self-leveling detachable base 3.

Figure 8A:
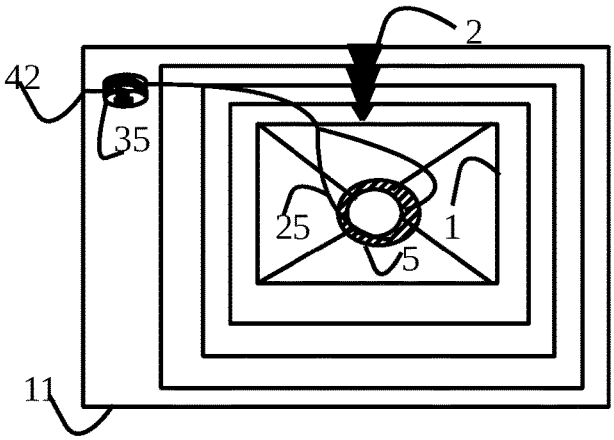
FIG. 8A shows a fully retracted transparent satellite view of one embodiment, as recited in FIG. 8, where as a pulley 35 and cable 25 are attached to the housing segment 11, with a pin(s) or rivet(s) 42, and attached to the mount point 5, as the deployment and retraction mechanism. Also, showing the spike(s) or key(s) 2, as the rigidity mechanism.

FIG. 8A shows a transparent satellite view, as recited in FIG. 8, where as the housing segment 11, the pulley 35 and cable 25, rigidity spike(s) or key(s) 2, a pin or rivet 42 for means of attaching the pulley 35 and cable 25, and the mount point 5 are visible.

Figure 8B:
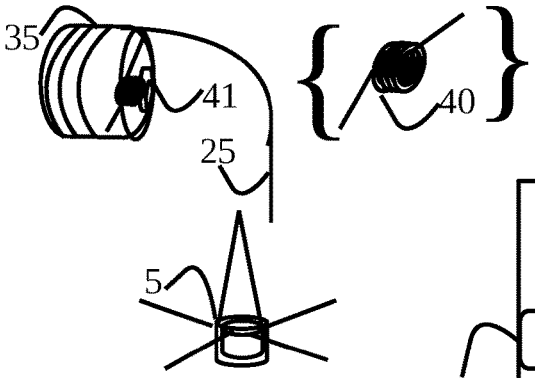
FIG. 8B shows an enlarged view of one embodiment of a deployment and retraction mechanism, where as the embodiment is manufactured of a pulley 35 and cable 25, a pulley-spring 40, and button 41 to release the pulley-spring 40, and the mount point 5; and in brackets, an enlarged view of the pulley-spring 40.

FIG. 8B shows an enlarged view of one embodiment of a retraction mechanism consisting of, but not limited to, a pulley 35 and cable 25, a pulley spring 40 and button 41 to release the pulley spring 40, and the mount point 5 for which the cable 25 would attach at the end opposite of the pulley 35; and in brackets, an enlarged view of the pulley spring 40.

Figure 8C:
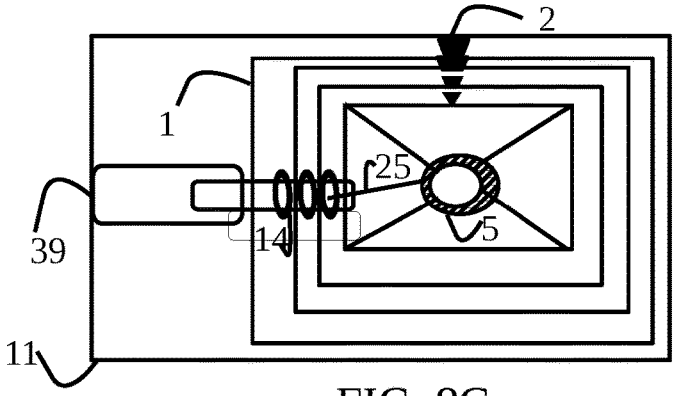
FIG. 8C shows a fully retracted transparent satellite view of one embodiment, as recited in FIG. 8, where as an alternative embodiment of a deployment and retraction mechanism is recited as the housing segment 11 manufactured with larger dimensional values to accommodate a pneumatic actuator 39, fitted into the punched holes 14 and attached to a cable 25 that attached at its' other end to the mount point 5. Also, showing the spike(s) or keys 2, as the rigidity mechanism.

FIG. 8C shows a transparent satellite view of an alternative embodiment of the deployment and retraction mechanism, where as the housing segment 11 is manufactured with greater dimensions in order to accommodate room for a pneumatic linear and rotating actuator 39 for means of achieving expansion and retraction. The actuator 39 is located on the inside wall of the housing segment 11. The rotating mechanism of the actuator 39 is connected to a cable 25 that connects on the opposite end to the mount point 5 inside the base segment 12. The actuator 39 threads through the punched holes 14 of the segments 1; thereby, holding the segment(s) 1 in the housing segment 11 until user intervention initiates the actuator 39 allowing the segment(s) 1 to pass by the rigidity spike(s) or key(s) 2 until the desired elevation is achieved and the user interrupts the pneumatic actuator 39. There is freedom in deployment and retraction mechanism based on the desired utility of the expandable sustainable member beam 10, such as, but not limited to: user intervention, a pulley 35 and cable 25, co2 cartridge, explosion, motor, ratchet system, nitinol steel, magnets, magnetized motor, etc.

Figure 9:
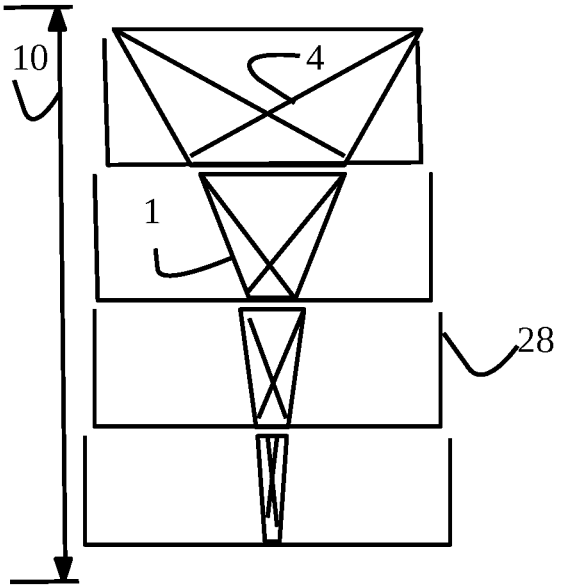
FIG. 9 shows a transparent view of one embodiment of the expandable sustainable member beam 10, fully expanded, where as each segment 1 is fitted with goal posts frames 28 on the outermost southern corners of the segments 1.

FIG. 9 shows a view of one embodiment of an expandable sustainable member beam 10, fully expanded, where as the segment(s) 1 are manufactured with, but not limited to, rods 4 to create a goal post frame 28 on the outer most southern corners of the segment(s) 1. The goal post frame 28 expands outward laterally for a distance equal or greater than the distance of the largest latitudinal dimensional value of the previous segment 1 and the respective goal post frame 28, and then expands upward in longitudinal distance less than or equal to the segment 1 for which it is attached. Thereby, creating segment(s) 1 with a goal post frame 28 that retract and expand in unison with the segment(s) 1. The goal post frame 28 increases the overall latitudinal dimensional value of the expandable sustainable member beam 10; and thus, creates utility in latitudinal stabilization by means of increasing the overall dimensional physicality of the segments 1 available for support.

Figure 9A:
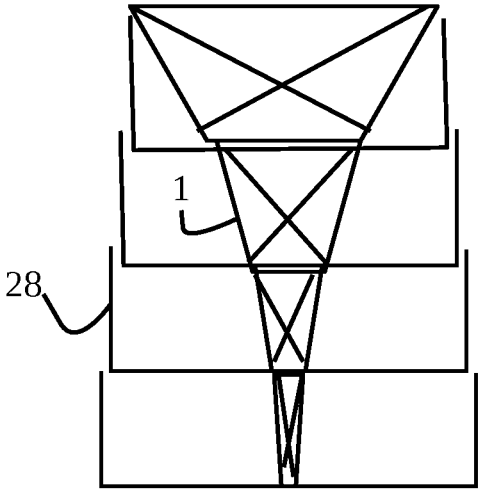
FIG. 9A shows a transparent view of one embodiment of the expandable sustainable member beam 10, as recited in FIG. 9, where as the segments 1, fitted with goal post frames 28, are minimally retracted.

FIG. 9A shows a view of one embodiment, as illustrated in FIG. 9, where as the segments 1 are minimally retracted to clarify the goal post frames' 28 ability of fitting outside the previous goal post frames' 28 of the previous segments 1.

Figure 9B:
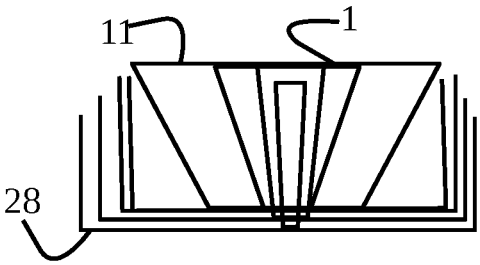
FIG. 9B shows a transparent view of one embodiment, as recited in FIG. 10, where as the segments 1, fitted with goal post frames 28, are retracted.

FIG. 9B shows a view of one embodiment, as recited in FIG. 9, where as the goal post frames 28, the housing segment 11, and the segments 1, are recited in their fully retracted position in order to clarify the mechanical means of retractability for the goal post frames 28 and segments 1.

Figure 9C:
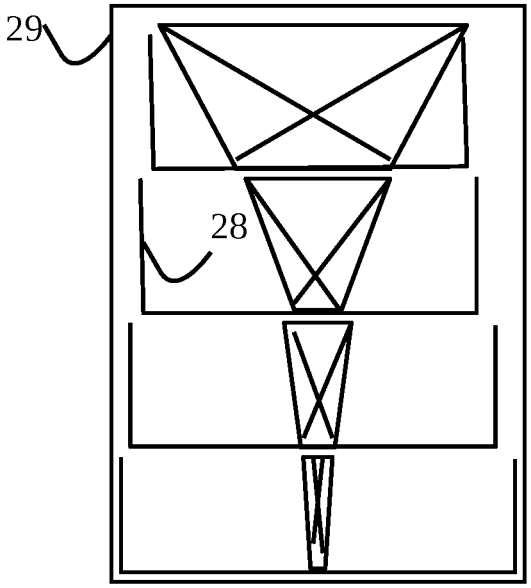
FIG. 9C shows a transparent view of one embodiment, as recited in FIG. 10, where as the goal post frames 28 support an attached skin 29.

FIG. 9C shows a view of one embodiment, as recited in FIG. 9, in the fully expanded position with an attached solid surface skin 29 to illustrate the utility of the goal post frame 28 providing means of support to a larger surface than that of a conventional beam.

Figure 10:
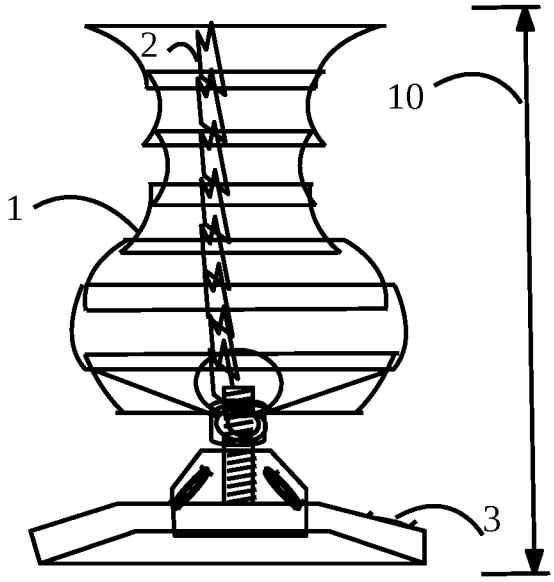
FIG. 10 shows a transparent view of one embodiment of an expandable sustainable member beam 10, where as the pattern, process and method for manufacture are applied to an irregular elliptic shape with varying dimensions from its' northern most segment 1 to its' southern most segment 1. Also, showing an alternative mechanism to the rigidity spike or key 2, and a self-leveling detachable base 3.

FIG. 10 shows a transparent view of one embodiment of an expandable sustainable member beam 10, fully expanded, of which the created pattern, process, and method of manufacture of the invention is applied to an expandable sustainable member beam 10 of an alternative shape consisting of varying dimensions from its' northern most segment 1 to its' southern most segment 1. Illustrating the patterns' mechanical means of being applied to segment(s) 1 having the freedom of form and of geometric shapes. Also, showing one embodiment of the spike(s) or key(s) 2 and the self-leveling detachable base 3.

Figure 10A:
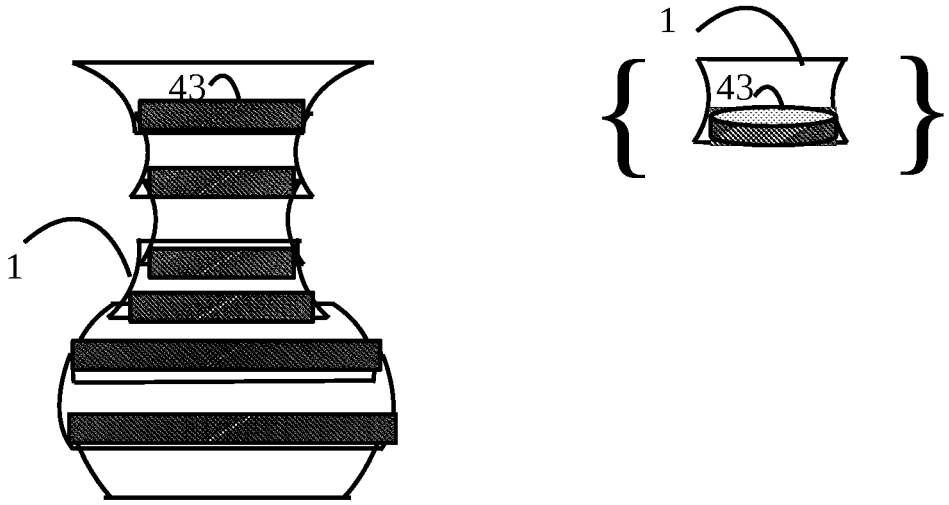
FIG. 10A shows a transparent view of the one embodiment, as recited in FIG. 10, in which the segments 1 are fitted with a flexible gasket 43.

FIG. 10A shows the fully expanded version of the embodiment recited in FIG. 10, where as a the segment 1 walls are formed solid and a bladder or flexible gasket 43 is affixed to, but not limited to, the southern most area of the inner walls of each segment 1. Thus, creating a means of filling gaps created by varying circumferences, and or, dimensions; and in brackets, shows an enlarged view of a single segment 1 with a gasket 43 affixed to the southern most area of the inner wall. Thereby, creating an expandable sustainable member beam 10 with liquid proof capabilities.

Figure 11:
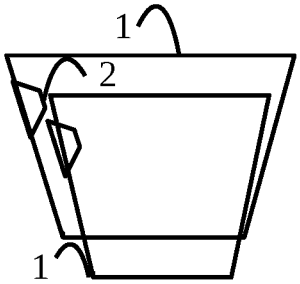
FIG. 11 shows a transparent front view of two segments 1, partially expanded, which are fitted with an alternative embodiment of the rigidity mechanism, recited as spikes or keys 2, where as the spikes or keys 2 are manufactured as a trapezoid shaped body, located within the segment(s)' 1 walls.

FIG. 11 shows a transparent view of two segments 1, partially expanded, which are fitted with an alternative embodiment of the rigidity mechanism spike(s) or key(s) 2, insofar as, the spike(s) or key(s) 2 are recited as a body manufactured of 3D trapezoid shapes with expanding dimensional values and hollow walls on their inter-sectional sides. In this illustration, the spike(s) or key(s) 2 are located inside the northern most side of the segment 1 wall, where as the inter-sectional sides face north and south respectively and together create a severe slope. Beginning at the northern most portion and ending facing south, with its' southern most side fitted into the hollow space of the northern most side of the subsequent spike or key 2 with larger dimensional values on the inter-sectional sides, repetitively and with plurality, until all subsequent trapezoid shaped spike(s) or key(s) 2 are thereby interlocking with the next subsequent spike or key 2 with larger dimensional values on its' inter-sectional sides. The severe slope of the northern most side of the spike or key 2 allows subsequent segments 1 to pass uninhibited through the previous segment 1 and its' attached spike or key 2. However, when the first, northern most, trapezoid shaped spike or key 2 is turned on its' side by user intervention, the subsequent interlocking trapezoid shaped spike(s) or key(s) 2 are turned respectively, in plurality, and in unison. Thus, the spike(s) or key(s) 2 presents their parallelogram sides north and south respectively, where as the northern side is facing towards the southern wall of the previous respective segments 1, thus blocking the previous segment 1; thereby, prohibiting the reverse motion and causing rigidity.

Figure 11A:
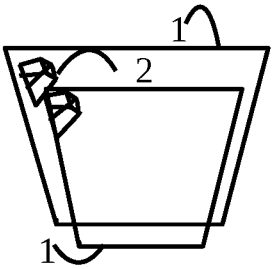
FIG. 11A shows a transparent front view of two partially expanded segments 1, as recited in FIG. 11, where as the trapezoid shaped spike or key 2 is in the turned position; thereby, prohibiting segments 1 from reverse motion.

FIG. 11A shows a transparent view of two segments 1 partially expanded, as recited in FIG. 11, where as the trapezoid shaped spike or key 2 is in the turned position. Thereby, prohibiting segments 1 from reverse motion.

Figure 11B:
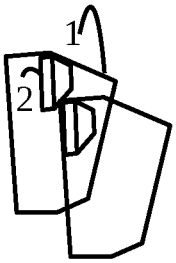
FIG. 11B shows a transparent side view of one segment 1, as recited in FIG. 11, of the trapezoid shaped spikes or keys 2.

FIG. 11B shows a transparent side view of two segments 1, recited in FIG. 11, of the trapezoid shaped spike(s) or key(s) 2.

Figure 12:
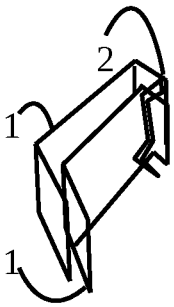
FIG. 12 shows a transparent view of two segments 1, with an alternative embodiment of the rigidity mechanism, where as the manufactured spike or key 2 resemble an "M". However, during deployment the created design allows the spike or key 2 to elongate; thereby, allowing segments 1 to pass uninhibited.

FIG. 12 shows a transparent view of two segments 1, as recited in FIG. 11, with an alternative embodiment of the rigidity mechanism spike(s) or key(s) 2. Using, but not limited to, and having freedom in material, a sheet material is cut into a rectangle shape having a longitudinal and latitudinal value a fraction of a segment 1 wall. The rectangle shape is then molded by way of compressed force, or cuts along latitudinal lines in ⅓ sections that expand less than the full depth and thickness of the sheet material. The first and last being cuts on one side of the sheet material and the middle cut on the opposite side; so that the rectangle shape when compressed and folded resembles the letter "M" and thus allowing for the creation of an accordion movement. The "M" shape is utilized as a spike or key 2 and is attached to the inside wall of a segment 1, where as the first and last slices face towards the segment 1 wall for which it is attached, and the middle slice faces out toward the segment 1 cavity. When the spike or key 2 is pushed by a subsequent segment 1 during the deployment process the "M" shape has an accordion movement and diminishes its' latitudinal dimensional value, while lengthening its' longitudinal dimensional value. Thereby, allowing the subsequent segments 1 to pass uninhibited. However, once the segment 1 has passed the spike or key 2, it has an accordion movement and returns back to it's original shape of resembling an "M"; thus, prohibiting segments 1 from reverse motion.

Figure 12A:
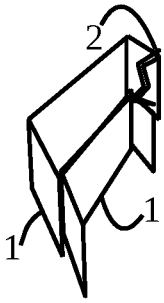
FIG. 12A shows a transparent view of two segments 1, where as the spike or key 2 has returned to its' "M" shape; thereby, prohibiting segments 1 from reverse motion.

FIG. 12A shows a transparent view of two segments 1, as recited in FIG. 12, where as the spike or key 2 has returned to its' "M" shape; thereby, prohibiting segments 1 from reverse motion.

Figure 13:
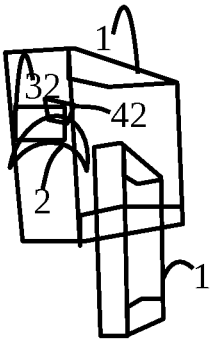
FIG. 13 shows a transparent view of two segments 1, with an alternative embodiment of the rigidity mechanism spikes or keys 2, where as manufactured of a geometric shape, such as a semi-circle, is placed in a cut-out of a segment 1, where as the spikes or keys 2 are in the compressed position allowing for deployment.

FIG. 13 shows a transparent view of two segments 1 in the expanded position for which an alternative embodiment of the rigidity mechanism spike(s) or key(s) 2 is, but not limited to, and having freedom in form, a half circle. The half circle is attached off center in a hollow space 32 provided by manufacture in the walls' of a segments 1. A loosely fastened pin or rivet 42 attaches the spike(s) or key(s) 2, off center, to the segments 1 in a manner that allows for movement of the spike(s) or key(s) 2. The off center position causing the spike(s) or key(s) 2 to be weighted and having means of returning to its' original position. During expansion the loosely fitted spike(s) or key(s) 2 provides a mechanical means for the spike or key 2 to be pushed out of the way by a passing segment 1.

Figure 13A:
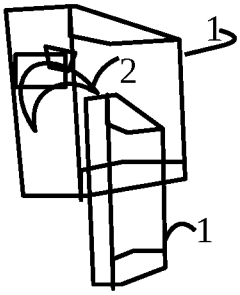
FIG. 13A shows a transparent view of two segments 1, as recited in FIG. 13, where as the spike or key 2 has returned to its' weighted position, thus prohibiting reverse motion.

FIG. 13A shows one embodiment of the rigidity mechanism spike(s) or key(s) 2, as recited in FIG. 13, where as the spike(s) or key(s) 2 has returned to its' weighted position; thus, protruding the spike(s) or key(s) 2 into the cavity wall towards the subsequent segments' 1 cavity, effectively creating a block which prohibits reverse motion of subsequent segments 1. This and other embodiments may benefit from an additional locking mechanism on the spike(s) or key(s) 2, such as, but not limited to, a clip (not shown) for which to hold the spike(s) or key(s) 2 while in the rigid position.

Figure 14:
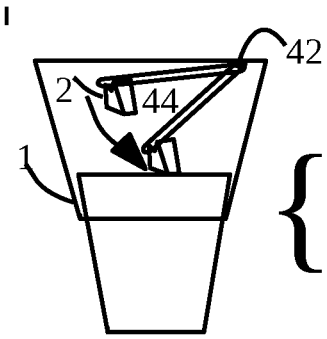
FIG. 14 shows a transparent view of two segments 1 in the expanded position with an alternative embodiment of the rigidity mechanism spikes or keys 2, where as the inner walls of the segments 1 are fitted with a spike or key 2 attached to a sliding rod 44, and connected inside the segment 1 walls with a pin or rivet 42; and in brackets, an enlarged view of the sliding rod 44, and spike or key 2.

FIG. 14 shows a transparent view of two segments 1 in the expanded position with an alternative embodiment of the rigidity mechanism spike(s) or key(s) 2 in which the inner walls of the segments 1 are fitted with a sliding rod(s) 44 with a longitudinal value less than 100 percent of the segments' 1 smallest longitudinal value that are attached by a loosely fastened pin or rivet 42. The unattached end of the sliding rod(s) 44 is fitted with a rigidity spike(s) or key(s) 2. The sliding rod(s) 44 and spike(s) or key(s) 2, when in the retracted position, are held in place by the friction of the next subsequent segment(s) 1. However, during deployment, the segment(s) 1 move away from the sliding rod(s) 44 and key(s) 2; thus, releasing friction and allowing the sliding rod(s) 44 and spike(s) or key(s) 2 to slides downward in the cavity of the segment 1 and rest on the wall. Thereby, exposing the spike or key 2 and prohibiting reverse motion of subsequent segments 1; and in brackets, an enlarged view of the sliding rod(s) 44, and spike(s) or key(s) 2.

Figure 15:
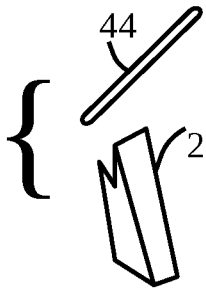
FIG. 15 shows a transparent view of two segments 1 that are in the expanded position with an alternative embodiment of the rigidity mechanism spike(s) or key(s) 2, where as the northern most section of the outer wall of the segments 1 and the southern most section of the inner wall of the segments 1 are manufactured with "U" shaped bar, where as a concave surface in which a hollow cavity is created; and in brackets, an expanded and enlarged view of the spikes or keys 2, hollow pin 45, tension-spring 46, and a created hole 47.
Figure 15:
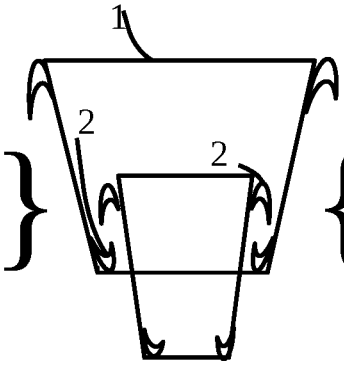
Figure 15:
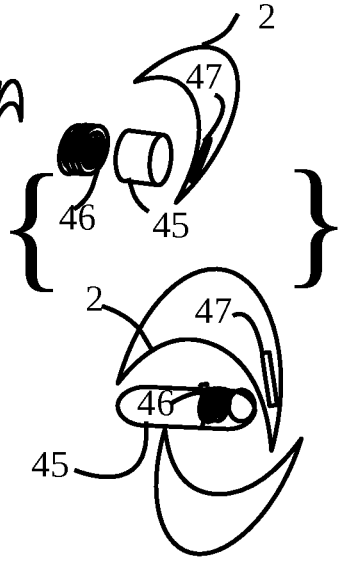

FIG. 15 shows a transparent view of two segments 1 that are in the expanded position with an alternative embodiment of the rigidity mechanism spike(s) or key(s) 2, where as the spike(s) or key(s) 2 are recited as "U" shaped bar, or similarly concaved surface in which a hollow cavity exists. The spike(s) or key(s) 2 are attached in duplicity to the northern most adjacent sections of the outer walls of the segments 1 and the southern most adjacent sections of the inner walls of the segments 1. The set(s) of spike(s) or key(s) 2 are affixed on the walls of a segment(s) 1 in a juxtaposed position; one set is affixed with the concave area facing south and one set is affixed with the concave area facing north. During deployment, as the segments 1 move downward, gravity forces the outer wall northern of the spike(s) or key(s) 2 to fall into the concave area of the inner wall southern spike(s) or key(s) 2, thus interlocking the spikes(s) or key(s) 2. Additionally, and in brackets, the opposing set of spike(s) or key(s) 2 are manufactured with a hollow pin 45 fitted with a tension spring 46 on either end of the spike(s) or key(s) 2; the spike(s) or key(s) 2 in the juxtaposed position are manufactured with a created hole 47 as to receive the hollow pin 45 and tension spring 46, thus creating rigidity between the segments 1 when in the expanded position.

FIG. 16 shows a transparent view of two segments 1 that are in the expanded position with an alternative embodiment of the rigidity mechanism spike(s) or key(s) 2. The spikes(s) or key(s) 2 are created of a five sided three dimensional polygon geometric shape, and are fitted on the inside walls of the segments 1. The spike(s) or key(s) 2 are manufactured hollow where by allowing subsequent spike(s) or key(s) 2 to be fitted inside the current spike or key 2; thus creating the means for all the spike(s) or key(s) 2 to be interlocking and controllable from the northern most spike or key 2. In the relaxed or forward state of the spike(s) or key(s) 2, their geometric shapes together, form a steep slope; thereby, allowing subsequent segments 1 to pass uninhibited through the current segment 1. However, during expansion, the user may induce reverse motion of the spike(s) or key(s) 2 with a lifting cable 48 that is threaded through a created hole 47 in the northern most point of the spike(s) or key(s) 2 and attached with a pin or rivet 42 to the southern most segment 1. When the lifting cable 48 is pulled backward all the spike(s) or key(s) 2 are pulled backward in plurality and unison; thereby, forcing the southern most point of each spike or key 2 to protrude inward towards the segment 1 cavity. Thus, prohibiting segments 1 from reverse motion and causing rigidity at the desired longitudinal value. The reverse motion of the spike(s) or keys(s) 2 is not limited to user intervention and has freedom in mechanism such as machine, actuator 39, etc.

FIG. 16A shows a transparent view of two segments 1 that are in the expanded position with an alternative embodiment of the rigidity mechanism spike(s) or key(s) 2, as recited in FIG. 16, where as the spike(s) or key(s) 2 are in the protruding position; thus, providing means of prohibiting reverse motion and creating rigidity among the segments 1. Furthermore, a cross-bar 49 is shown as an alternative mechanism for controlling the spike(s) or key(s) 2. The cross-bar 49 is attached to the northern most spike or key 2 for which it may be activated by user intervention, but not limited to, and has the freedom of activation by mechanism of a motor, actuator, spring, magnets, etc.

FIG. 17 shows a transparent view of two segments 1 that are in the expanded position with an alternative embodiment of the rigidity mechanism spike(s) or key(s) 2, as recited in FIG. 15. However, the rigidity mechanism of the "U" shaped bar are realized by a hook 50 and flap style tension spring 65 fitted north and south respectively and juxtaposed positions on the segments 1. During deployment the hooks 50 from the descending segments 1 slide towards the flap style tension springs 65 causing them to rotate forward and open allowing the hook 50 to enter the "U" shape bar. However, once the hook 50 has passed the flap style tension spring 65 it retracts back to its' original closed position, thus prohibiting reverse motion of segments 1; and in brackets, three enlarged views: I. The "U" shape bar fitted with a hook 50 and flap tension spring 65 prior to contact, II. The contact position of the hook 50 and the flap tension spring 65 locked together, III. An enlarged view of the flap tension spring 65, as may be manufactured with, but not limited to, a deformed wire that is fitted with two holding cylinders 52 on either side of the wire allowing for the flap tension spring 65 to rotate forward into the the "U" shape bar.

FIG. 18 shows a transparent view of two segments 1 that are in the expanded position with an alternative embodiment of the rigidity mechanism spike(s) or key(s) 2, where as portions the segment(s) 1 are manufactured of perforated flat-bar 66 and are utilized to create rigidity by the spike(s) or key(s) 2. The spike(s) or key(s) 2 are manufactured of a holding pin 53, a hollow tube 54, a controlling pin 56, and base spring 58 attached to the base segment 12 as the means of creating rigidity; and in brackets, an enlarged view of the spike(s) or key(s) 2, where as the holding pin 53 and inner spring 55 are encased by a hollow tube 54 which is held in place by the controlling pin 56 in a perpendicular position behind the holding pin 53. The controlling pin 56 is threaded by a controlling cable 57. When the controlling cable 57 is pulled the controlling pin 56 is pulled away from the inner spring 55; thereby, forcing the holding pin 53 to retract from the perforated flat-bar 66 and allowing subsequent segments 1 to pass uninhibited. When the controlling cable 57 is relaxed, the base spring 58 recoils and pulls the controlling pin 56 back to its original position. Thereby, causing the inner spring 55 to push the holding pin 53 forward and back into the perforated flat-bar 66, thus locking the segments 1 together and creating rigidity.

FIG. 19 shows a view of one embodiment of the expandable sustainable member beam 10, fully expanded, where as the segments 1 are manufactured with walls that have severe tapering or cut-outs 59 to provide notched space at strategic portions of the southern regions of the segment 1 walls; thereby, allowing the next sequential segment 1 to tip on its' axis without interference from the walls of the previous segment 1. Thus, creating an expandable sustainable member beam 10 capable of varying degrees of curvature.

FIG. 19A shows a front view of the expandable sustainable member beam 10, fully expanded, as recited in FIG. 19, in the curved position.

FIG. 19B shows an enlarged front view of two expanded segments 1 with cut-outs 59, as recited in FIG. 19, where as the an alternative embodiment to the rigidity mechanism spike(s) or key(s) 2 is shown prohibiting reverse motion.

FIG. 19C shows a transparent 3D enlarged front view of two expanded segments 1 with cut-outs 59, with an alternative mechanism of the rigidity spike(s) or key(s) 2, where as the spike(s) or key(s) 2 are manufactured of catching rods 60 attached to the outside walls of the segment(s) 1, a flexible hook 61 consisting of two curls 62 manufactured of flexible material inside the segment(s) 1 walls, which becomes elongated by pressure from the passing segment 1 during the deployment process and becomes a single curl 63; thereby, decreasing its latitudinal value in the segment 1 cavity and allowing subsequent segments 1 to pass uninhibited and also forcing the flexible hook 61 to become a single curl 63 for which to catch the catching rod 60 from the descending segment 1. However, once the largest latitudinal dimensions of the segment 1 passes the single curl 63, it recoils and regains its' original latitudinal value of two curls 62; thereby entrapping the catching rod 60 and creating a means rigidity and thus prohibits reverse motion. And in brackets, from top to bottom: shows an enlarged view of two curls 62, a single curl 63, the catching rod 60 entrapped inside the two curls 62, and the single curl 63 creating a flexible hook 61, where as the descending catching rod 60 is caught.

Figure 20:
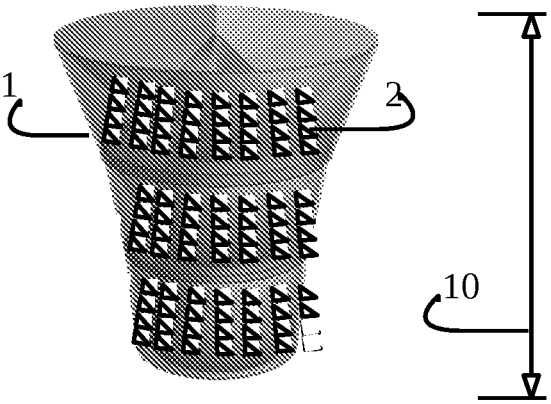
FIG. 20 shows a fully expanded view of one embodiment of said expandable sustainable member beam 10, where as the segments 1 are manufactured as cylinders and the means of rigidity are spike(s) or key(s) 2, as recited in FIG. 1.

FIG. 20 shows a fully expanded view of one embodiment of the expandable sustainable member beam 10 in which the segments 1 are manufactured as cylinders and the means of rigidity are spike(s) or key(s) 2, as recited in FIG. 1.

Figure 21:
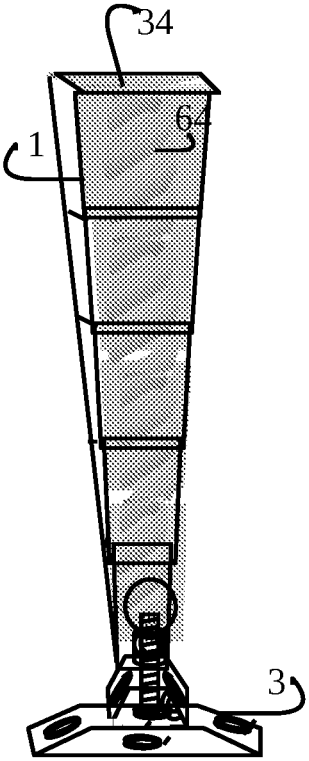
FIG. 21 shows a view of one embodiment of an expandable sustainable member beam 10, fully expanded, with the self-leveling detachable base 3, where as a structural spring(s) 64 is inserted into the segment(s)' 1 cavities 34.

FIG. 21 shows a view of one embodiment of an expandable sustainable member beam 10, fully expanded, and with the self-leveling detachable base 3, where as a structural spring(s) 64 is inserted into the segment(s)' 1 cavity(ies) 34. The addition of the structural spring(s) 64 may prove to have other utility such as, but not limited to: the expandable sustainable member beam 10 utilized as a tension bar, an expandable sustainable member beam 10 with both rigidity and flexibility, and an expandable sustainable member beam 10 with seismic value. Further correlation is needed to determine seismic benefits.

The invention claimed is:

1. An expandable sustainable member beam for creating a structural frame comprising:

a housing segment that holds a plurality of segments that make up the beam wherein the beam is capable of being expanded and retracted along a longitudinal length, leveled, and positioned at different angles without the use of tools, wherein the plurality of segments diminish in latitudinal values from the housing segment to the innermost segment;

keys positioned on the segments prohibiting reverse motion at various desired longitudinal values, the keys further allowing segments of lesser latitudinal values to pass uninhibited through segments with greater latitudinal values;

wherein the innermost segment is a base segment comprising a mount point, the mount point receiving a threaded rod from a self-leveling detachable base wherein a perforated ball-nut threads on to the threaded rod to attach the base segment to the self-leveling detachable base;

wherein the segments include a rigidity mechanism comprising keys and a locking mechanism comprising a controlling cable attached to the keys;

means for deploying the segments comprising a pulley located within the housing segment, a cable attached at one end to the pulley and at the opposite end to the mount point, wherein the means for deploying the segments includes a pulley-spring and a holding pin attached to a holding cable;

the beam capable of being used singularly or as a plurality to create a stand or work surface;

the beam further including:

a gasket for liquid containment;

a wand that may be extended perpendicularly to the beam for draping a fabric to create a private space;

a connection system for forming a structural frame with additional beams;

wherein the beam is load bearing and includes expandable rods that provide for varying expansion of the segments relative to one another, each rod held by a groove in a respective corner of inner walls of each segment.

2. The expandable sustainable member beam of claim 1, wherein segment walls have cut out sections at either a southern or northern perimeter proportionally sized to allow for sections of subsequent segments to enter the walls of respective previous segments, providing for varying degrees of curvature.

* * * * *